US010892582B2

(12) United States Patent
Kawashima et al.

(10) Patent No.: US 10,892,582 B2
(45) Date of Patent: Jan. 12, 2021

(54) CONNECTOR WITH UPPER AND LOWER COVERS

(71) Applicant: YAZAKI CORPORATION, Tokyo (JP)

(72) Inventors: Kenichi Kawashima, Makinohara (JP); Keiichiro Kurashige, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/656,570

(22) Filed: Oct. 17, 2019

(65) Prior Publication Data

US 2020/0127409 A1 Apr. 23, 2020

(30) Foreign Application Priority Data

Oct. 19, 2018 (JP) ..... 2018-197480
Oct. 30, 2018 (JP) ..... 2018-204153

(51) Int. Cl.
*H01R 13/506* (2006.01)
*H01R 13/424* (2006.01)
*H01R 4/242* (2018.01)
*H01R 4/18* (2006.01)

(52) U.S. Cl.
CPC ..... *H01R 13/506* (2013.01); *H01R 13/424* (2013.01); *H01R 4/185* (2013.01); *H01R 4/242* (2013.01)

(58) Field of Classification Search
CPC .... H01R 13/506; H01R 13/424; H01R 4/185; H01R 4/242
USPC ..... 439/656
See application file for complete search history.

(56) References Cited

U.S. PATENT DOCUMENTS 3,594,702 A 7/1971 Frey
4,142,771 A 3/1979 Barnes et al.
4,343,528 A * 8/1982 Lucius ..... H01R 13/514 439/601
4,867,705 A * 9/1989 Yuasa ..... H01R 13/4223 439/595
5,120,269 A 6/1992 Endo et al.
(Continued)

FOREIGN PATENT DOCUMENTS

JP 4-95369 A 3/1992
JP 9-213399 A 8/1997
(Continued)

*Primary Examiner* — Renee S Luebke
*Assistant Examiner* — Paul D Baillargeon
(74) *Attorney, Agent, or Firm* — Kenealy Vaidya LLP

(57) ABSTRACT

A connector includes a terminal configured to be connected to a wire, a plate-like housing has a terminal accommodating portion configured to accommodate the terminal, the housing having a ceiling wall portion that blocks an upper of a front portion of the terminal accommodating portion and an opening portion which is opened at an upper of a rear portion of the terminal accommodating portion, and a cover configured to cover the opening portion of the terminal accommodating portion when the cover is assembled to the housing. A protruding portion is provided on a front end portion of the cover. The protruding portion presses the terminal located in a primary locking position forward in the front-rear direction to move the terminal from the primary locking position to a regular insertion position when the cover is assembled to the housing.

4 Claims, 27 Drawing Sheets

(56) References Cited

U.S. PATENT DOCUMENTS

| | | | | | |
|---|---|---|---|---|---|
| 5,378,176 | A | * | 1/1995 | Sasai | H01R 13/4362<br>439/752 |
| 5,669,791 | A | * | 9/1997 | Endo | H01R 13/4362<br>439/752 |
| 6,083,053 | A | * | 7/2000 | Anderson, Jr. | H01R 24/84<br>439/687 |

FOREIGN PATENT DOCUMENTS

| | | | |
|---|---|---|---|
| JP | 10-308248 | A | 11/1998 |
| JP | 2010-61870 | A | 3/2010 |

* cited by examiner

CONNECTOR WITH UPPER AND LOWER COVERS

CROSS REFERENCE TO RELATED APPLICATIONS

This application is based on Japanese Patent Application (No. 2018-204153) filed on Oct. 30, 2018 and Japanese Patent Application (No. 2018-197480) filed on Oct. 19, 2018, the contents of which are incorporated herein by reference.

BACKGROUND OF THE INVENTION

1. Field of the Invention

The present invention relates to a connector.

2. Description of the Related Art

A connector including a terminal connected to an electric wire and a housing having a terminal accommodating portion that accommodates the terminal connected to the electric wire is widely known in the related art (see, for example, JP-A-H04-95369). In this type of connector, the terminal is generally crimped and fixed to the electric wire, and the terminal connected to the electric wire is accommodated in a regular insertion position of the terminal accommodating portion by inserting the terminal into the terminal accommodating portion from a rear end of the housing while holding the electric wire to which the terminal is fixed.

In recent years, with a demand for miniaturization of the connector, the terminal has been miniaturized, and a diameter of the electric wire has also been reduced. In a case where the electric wire is thin, when the terminal is inserted from the rear end of the housing by holding the electric wire to which the terminal is fixed, buckling is easy to occur in the electric wire. When buckling occurs in the electric wire, it is difficult to insert the terminal to the regular insertion position of the terminal accommodating portion.

SUMMARY OF THE INVENTION

The present invention has been made in view of the above circumstances, and an object thereof is to provide a connector capable of inserting a terminal into a regular insertion position of a terminal accommodating portion of a housing even when an electric wire connected to the terminal is thin.

In order to achieve the above object, the connector according to the present invention is characterized by the following (1) to (3).

(1) A connector including:

a terminal configured to be connected to a wire and extend in a front-rear direction;

a housing which has a plate-like shape and has a terminal accommodating portion configured to accommodate the terminal, the housing having a ceiling wall portion that blocks an upper of a front portion of the terminal accommodating portion and an opening portion which is opened at an upper of a rear portion of the terminal accommodating portion; and a flat plate-like cover configured to cover the opening portion of the rear portion of the terminal accommodating portion when the cover is assembled to the housing, in which a protruding portion is provided on a lower surface of a front end portion of the cover and the protruding portion protrudes downward; and in which the protruding portion presses a part of the terminal located in a primary locking position forward in the front-rear direction to move the terminal from the primary locking position to a regular insertion position when the cover is assembled to the housing.

(2) The connector according to the above (1), in which the cover is configured to be assembled to the housing by moving the cover forward with respect to the housing while the terminal is moved forward by pressing the protruding portion until a front end edge of the cover enters under a rear end edge of the ceiling wall portion while maintaining a state in which a rear part of the cover is inclined upward from a front part in a direction away from the housing, and then bringing the rear part of the cover near to the housing.

(3) The connector according to the above (1) or (2), in which the cover is configured to be assembled to the housing in a state where the front part of the cover is inclined upward from the rear part in a direction away from the housing while the protruding portion interferes with the terminal when the terminal is located in the primary locking position.

According to the connector having the configuration of the above (1), since the upper part (opening portion) of the rear portion of the terminal accommodating portion of the housing is opened, the terminal can be easily inserted to the primary locking position in the vicinity of the regular insertion position in the terminal accommodating portion while holding the terminal. In this state, the cover is assembled to the housing. In the assembly process, when the cover is moved to the front direction (forward) with respect to the housing, the terminal in the primary locking position is pressed forward by the protruding portion provided on the cover, so that the terminal can be moved to the regular insertion position.

As described above, even when the electric wire connected to the terminal is thin, the terminal can be certainty inserted to the regular insertion position. Further, even when the cover is assembled to the housing in a state where the terminal is in the primary locking position, the cover is detached from the housing, and the cover is assembled to the housing again while pressing the terminal forward by the protruding portion of the cover, so that it is possible to certainly insert the terminal in the primary locking position to the regular insertion position.

According to the connector having the configuration of the above (2), a shape of each component is designed such that the terminal reaches the (approximately) regular insertion position in a stage where the front end edge of the cover moving forward with respect to the housing enters under the rear end edge of the ceiling wall portion of the housing. Accordingly, after the terminal is inserted to the (approximately) regular insertion position by the protruding portion of the cover in the inclined state, the cover can be assembled to the housing by rotating the cover using the tip end side of the cover as a fulcrum. In addition, the terminal can reach the regular insertion position.

According to the connector having the configuration of the above (3), the cover is assembled to the housing in a state where the front part of the cover is inclined from the rear part in a direction away from the housing when the terminal is in the primary locking position. Therefore, a floating amount (floating height in the vertical direction) from the housing on the front part of the cover can be increased as compared with an aspect in which the cover is not inclined to the housing. Therefore, when it is detected that the cover is not assembled properly or the terminal is inserted halfway, the detection accuracy can be improved by measuring the floating amount using a checker fixture or the like. Furthermore, even though the terminal and the housing are miniaturized with a demand for miniaturization of the connector, it becomes possible to certainly detect the halfway insertion of the terminal.

According to the present invention, even when the electric wire connected to the terminal is thin, it is possible to provide a connector capable of inserting the terminal to a regular insertion position of the terminal accommodating portion of the housing.

The present invention has been described briefly. Further, details of the present invention will be clarified by reading a mode for carrying out the invention (hereinafter, referred to as "embodiment".) described below with reference to the attached drawings.

DESCRIPTION OF EMBODIMENTS

Embodiment

Figure 1:
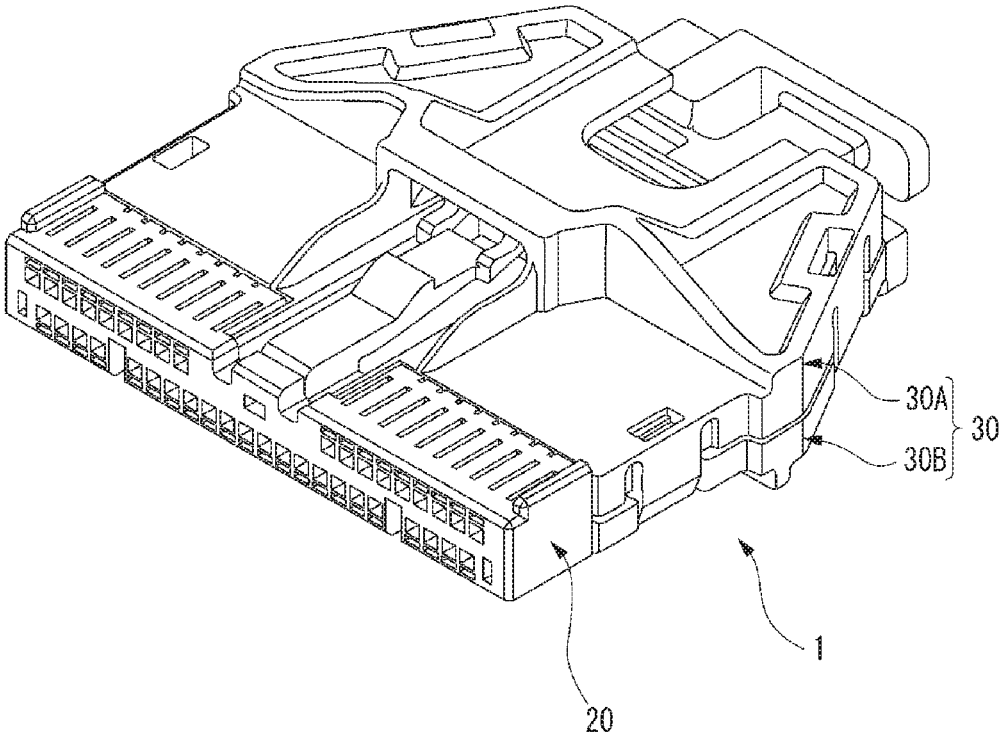
FIG. 1 is a perspective view of a connector according to the present embodiment.

Hereinafter, a connector 1 according to an embodiment of the present invention will be described with reference to the drawings. Hereinafter, for convenience of description, in an axial direction (fitting direction) of the connector 1 (which is same as a front-rear direction of a terminal), a side (left side in FIG. 1) to which a mating side terminal (not shown) is fitted is referred to as a front side, and an opposite side (right side in FIG. 1) is referred to as a rear side. An upper side and a lower side in FIG. 1 are referred to as an upper side or an upper and a lower side or lower, respectively.

Figure 2:
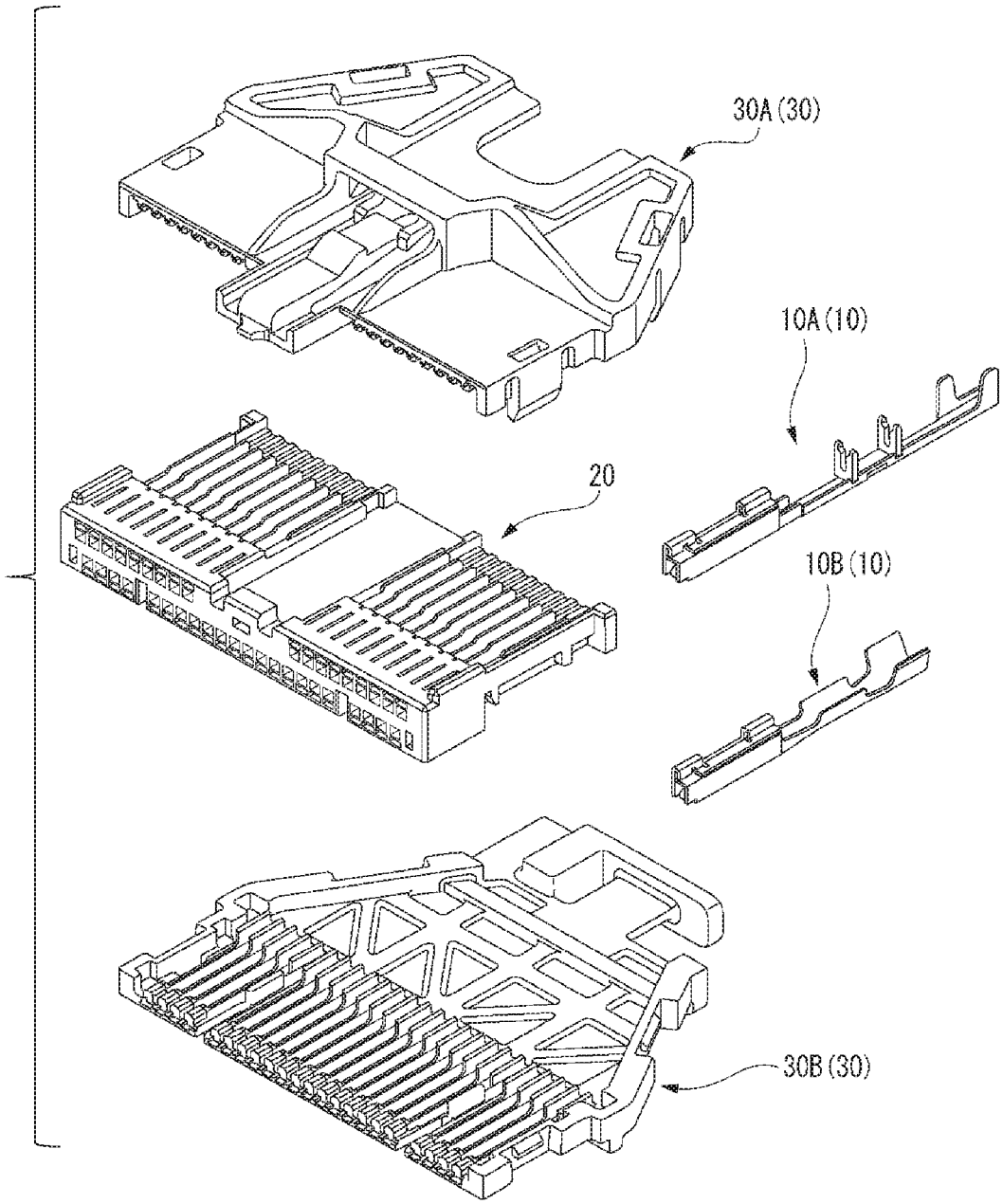
FIG. 2 is an exploded perspective view of the connector shown in FIG. 1.

As shown in FIG. 2, the connector 1 includes a terminal 10, a housing 20, and a cover 30. Hereinafter, each component constituting the connector 1 is described in order.

First, the terminal 10 is described with reference to FIG. 3 to FIG. 5. In this example, a terminal 10A shown in FIG. 3 and a terminal 10B shown in FIG. 4 are used as the terminal 10. Both of the terminals 10A and 10B are a female terminal formed by applying press processing, bending, or the like to a plate-like metal member, which includes a connecting portion 11 to which the mating side terminal (male terminal, not shown) is fitted, a conductor fixing portion 12 which fixes a conductor core wire of an electric wire W to the rear side of the connecting portion 11, and a coating fixing portion 13 which fixes a coating of the electric wire W to the rear side of the conductor fixing portion 12.

The connecting portions 11 of the terminals 10A and 10B have a square tubular shape, and a pair of protruding portions 14 protruding upward are formed at both end portions in a front-rear direction of a side in a width direction of an upper surface of the connecting portion 11. As will be described later, the protruding portion 14 particularly on a front side of the pair of protruding portions 14 engages with a lance 26 (see FIG. 8) of the housing 20, and fulfills a retaining function of the terminals 10A and 10B.

Figure 3:
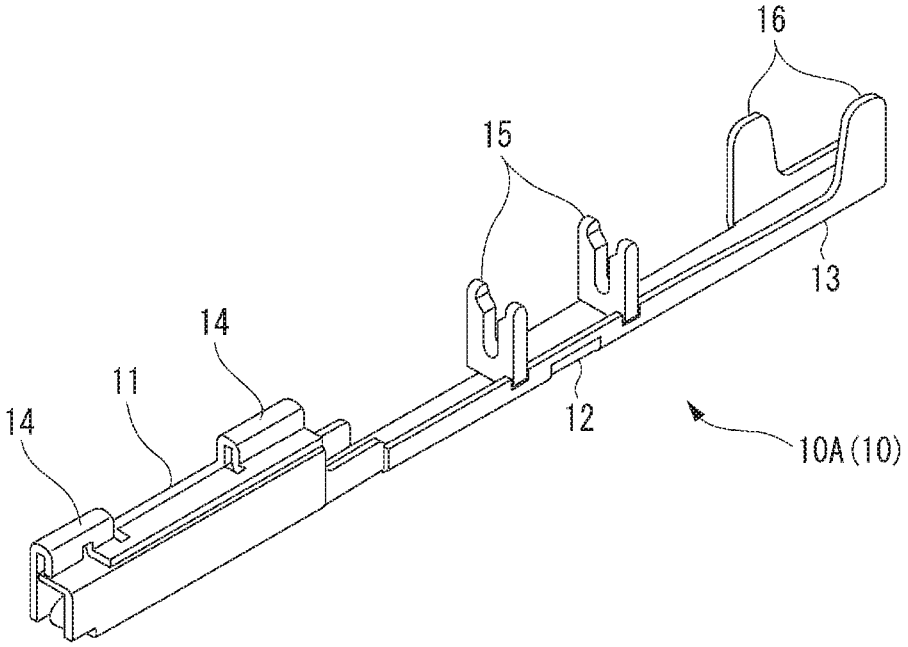
FIG. 3 is a perspective view of a first terminal shown in FIG. 2.
Figure 4:
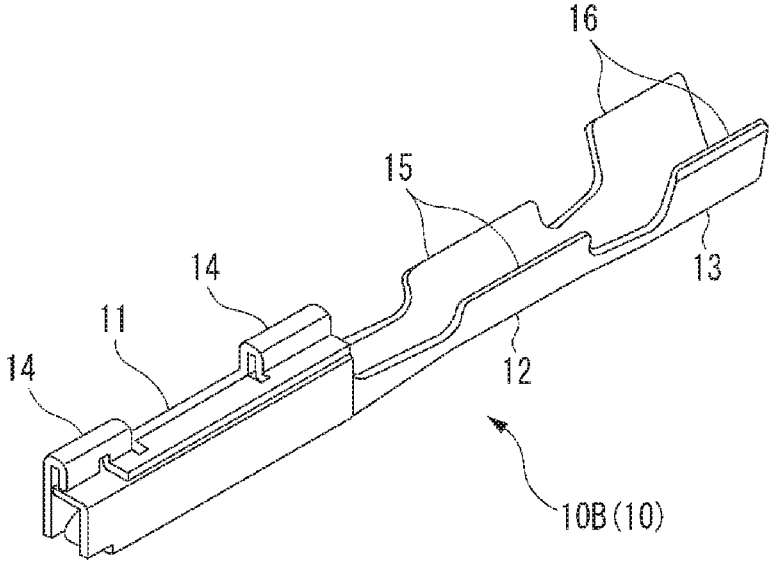
FIG. 4 is a perspective view of a second terminal shown in FIG. 2.

As shown in FIG. 3, a pair of crimping blades 15 is formed on the conductor fixing portion 12 of the terminal 10A. The conductor core wire of the electric wire W is crimped on the crimping blades 15, so that the conductor core wire is fixed and electrically connected to the conductor fixing portion 12. On the other hand, as shown in FIG. 4, a pair of caulking pieces 15 is formed on the conductor fixing portion 12 of the terminal 10B. By crimping the conductor core wire of the electric by the caulking pieces 15, the conductor core wire is fixed and electrically connected to the conductor fixing portion 12. A pair of caulking pieces 16 are formed on the coating fixing portions 13 of the terminals 10A and 10B. By crimping a coating of the electric wire W by the caulking pieces 16, the electric wire W is fixed to the coating fixing portion 13.

Figure 5:
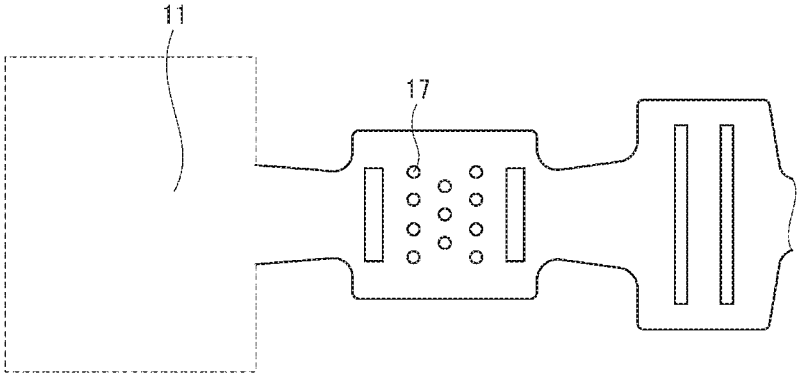
FIG. 5 is a plate-like metal member provided for producing the second terminal.

The terminal 10B is formed by applying press processing, bending, or the like to the plate-like metal member shown in FIG. 5. The connecting portion 11 is schematically shown. As can be understood from FIG. 5, a plurality of through holes 17 penetrating in a plate thickness direction are formed on the conductor fixing portion 12 of the terminal 10B. By providing the through holes 17 as described above, when the conductor core wire is crimped to the conductor fixing portion 12, the conductor core wire can enter the through hole 17 and adhere closely to an inner wall surface of the through hole 17 with pressure during crimping. As a result, the conductor core wire can be firmly fixed to the conductor fixing portion 12. Further, since a contact area between the conductor core wire and the conductor fixing portion 12 is increased, contact resistance therebetween is reduced.

Figure 6:
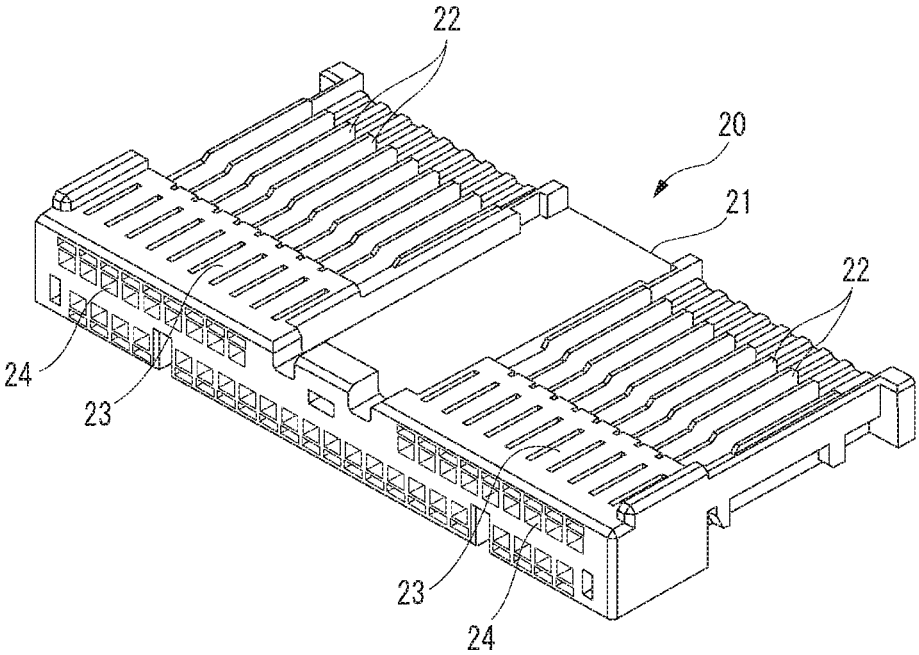
FIG. 6 is a perspective view of a housing shown in FIG. 2.
Figure 7:
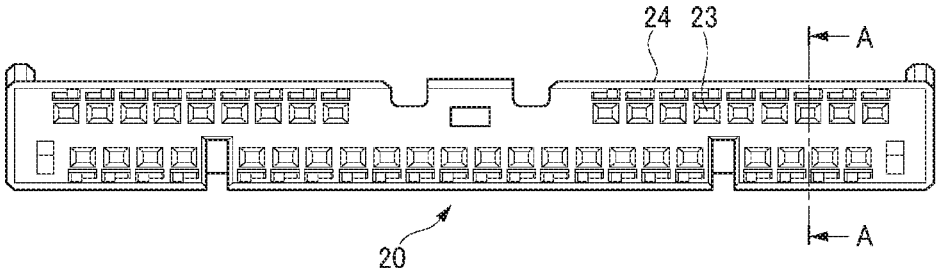
FIG. 7 is a front view of the housing.

Next, the housing 20 is described with reference to FIG. 6 to FIG. 12. In particular, as shown in FIG. 6 and FIG. 9, the housing 20 includes a housing body 21 having a rectangular flat plate shape. In each of upper and lower surfaces of the housing body 21, a plurality of terminal accommodating portions for accommodating the plurality of terminals 10 are formed. Since configurations of the upper surface side and the lower surface side of the housing body 21 are somewhat different but are substantially the same, only the configuration of the upper surface side of the housing body 21 will be described below.

A plurality of standing walls 22 extending in the front-rear direction are integrally formed on the upper surface of the housing body 21 at intervals in the width direction. Each standing wall 22 fulfills a function of partitioning two terminal accommodating portions adjacent in the width direction. That is, a plurality of terminal accommodating portions partitioned by the plurality of standing walls 22 are formed on the upper surface of the housing body 21 so as to be arranged in the width direction.

A ceiling wall portion 23 is integrally formed on a front portion of the housing body 21 so as to block an upper part (opening portion) of the terminal accommodating portion. That is, the front portion of the terminal accommodating portion has a cylindrical shape whose upper part (opening portion) is blocked by the ceiling wall portion 23, and an upper part of a rear portion of the terminal accommodating portion is opened. An opening 24 is formed at a front side end of each terminal accommodating portion (see FIG. 6 to FIG. 8). The mating side terminal (male terminal) is inserted into the terminal accommodating portion of the housing body 21 via the opening 24.

Figure 8:
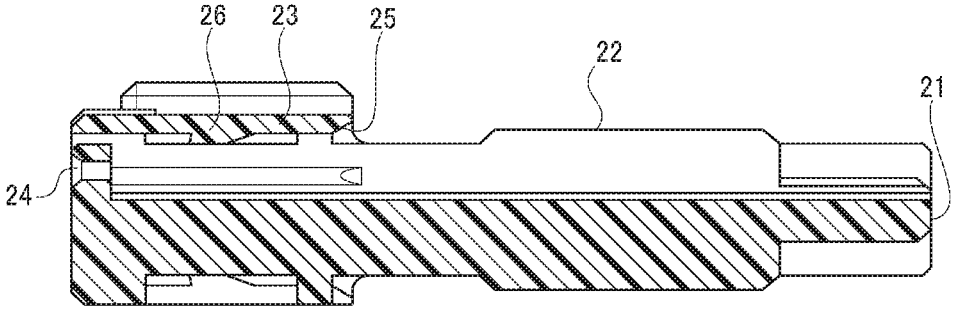
FIG. 8 is a sectional view taken along a line A-A in FIG. 7.
Figure 9:
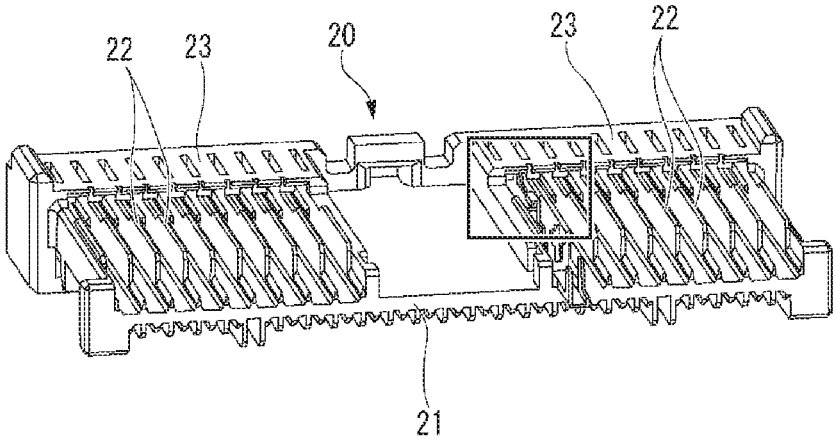
FIG. 9 is a perspective view of the housing seen from a rear side.

As shown in FIG. 8, a tapered surface 25 inclined rearward and downward is formed at a rear end edge of the ceiling wall portion 23. As will be described later, the tapered surface 25 is used when an upper cover 30A is assembled to the housing 20 (see FIG. 21). The lance 26 protruding downward toward the inside of each terminal accommodating portion is integrally formed on a lower surface of a central portion in a front-rear direction of the ceiling wall portion 23.

Figure 10:
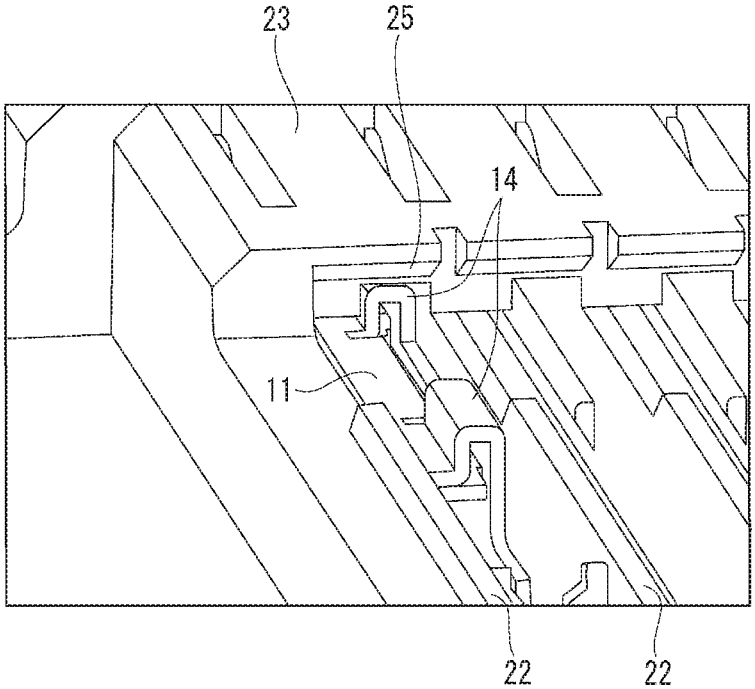
FIG. 10 is an enlarged view of the housing inside a frame of FIG. 9.

As described above, the upper part of the rear portion of each terminal accommodating portion is opened in the housing body 21. Therefore, as shown in FIG. 9 and FIG. 10, the terminal 10 can be easily inserted into a primary locking position (halfway insertion position) in the vicinity of a regular insertion position in the front portion (tubular portion) of the terminal accommodating portion by placing the terminal 10 on the rear portion of the terminal accommodating portion and pushing the front side in while holding the terminal 10 (see FIG. 11 and FIG. 12).

Figure 11:
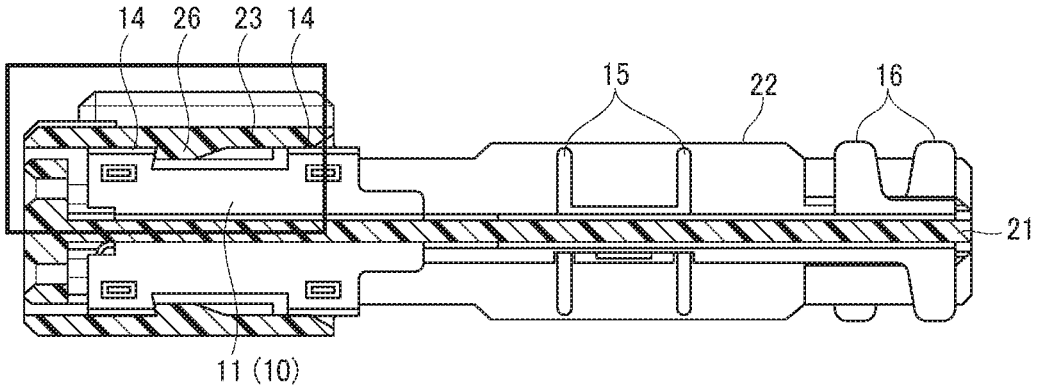
FIG. 11 is a sectional view corresponding to FIG. 8 in the housing in which the terminal is in a primary locking position.
Figure 12:
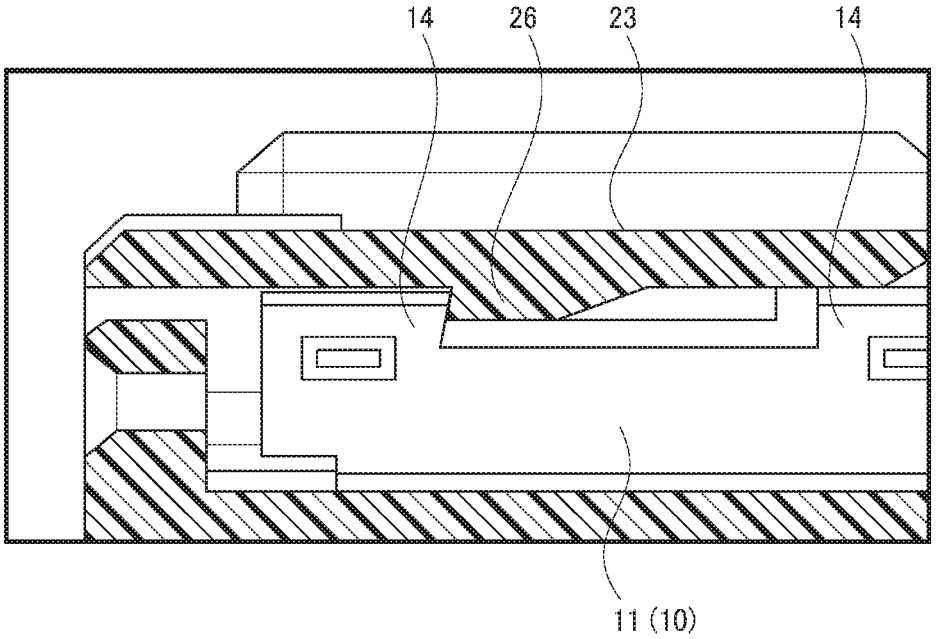
FIG. 12 is an enlarged view of the housing inside of a frame of FIG. 11.

In a process in which the terminal 10 is inserted to the primary locking position shown in FIG. 11 and FIG. 12, the lance 26 rides on the protruding portion 14 along with elastic deformation by abutting against the protruding portion 14 on the front side of the terminal 10, and then the lance 26 elastically returns to an initial position as the protruding portion 14 passes by. As a result, as shown in FIG. 12, the protruding portion 14 engages with the lance 26, so that a function of retaining the terminal 10 from the housing 20 is exhibited.

Next, the cover 30 will be described with reference to FIG. 13 to FIG. 22. In this example, the upper cover 30A and a lower cover 30B are used as the cover 30 (see FIG. 2). The upper cover 30A is assembled to the upper surface side of the housing body 21 to block the upper part of the rear portion of the terminal accommodating portion on the upper surface side, and the lower cover 30B is assembled to the lower surface side of the housing body 21 to block the lower side of the rear portion of the terminal accommodating portion on the lower surface side.

Figure 13:
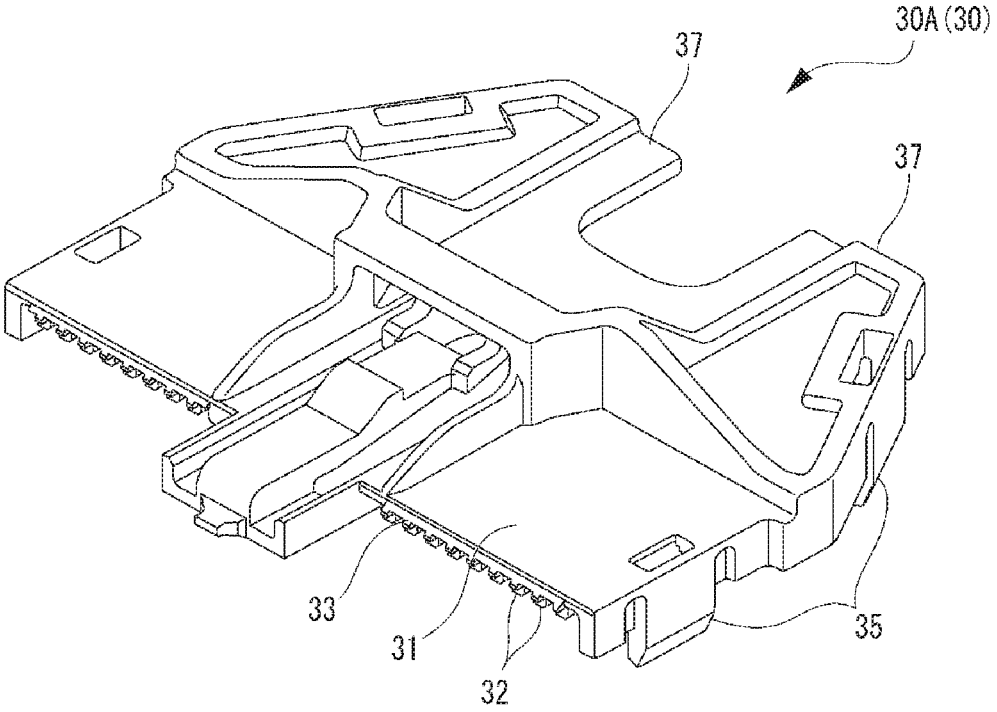
FIG. 13 is a perspective view of an upper cover shown in FIG. 2.
Figure 14:
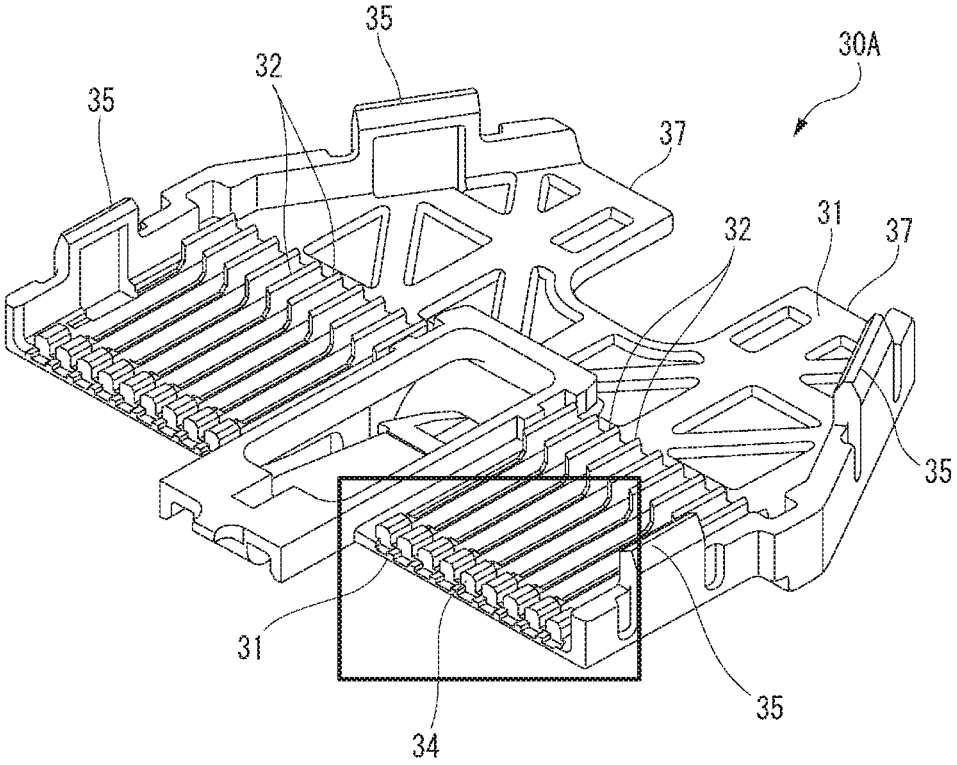
FIG. 14 is a perspective view of the inverted upper cover.

First, the upper cover 30A is described with reference to FIG. 13 to FIG. 15. FIG. 13 shows the upper cover 30A when assembled to the housing body 21, and FIG. 14 shows the inverted upper cover 30A.

The upper cover 30A includes a flat plate-like cover body 31. A plurality of standing walls 32 extending in the front-rear direction are integrally formed on the lower surface of the front portion of the cover body 31 at intervals in the width direction, which corresponds to the standing wall 22 of the housing body 21. Accordingly, in the assembled state of the upper cover 30A to the housing 20, the upper part of the rear portion of the terminal accommodating portion of the housing body 21 is blocked by the upper cover 30A, and the terminal accommodating portion having a tubular shape continuing in the front-rear direction is configured in the front portion and the rear portion of the terminal accommodating portion.

A tapered surface 33 inclined forward and upward is formed on a front end edge of the cover body 31 of the upper cover 30A. As will be described later, the tapered surface 33 is used when the upper cover 30A is assembled to the housing 20 (see FIG. 21).

Figure 15:
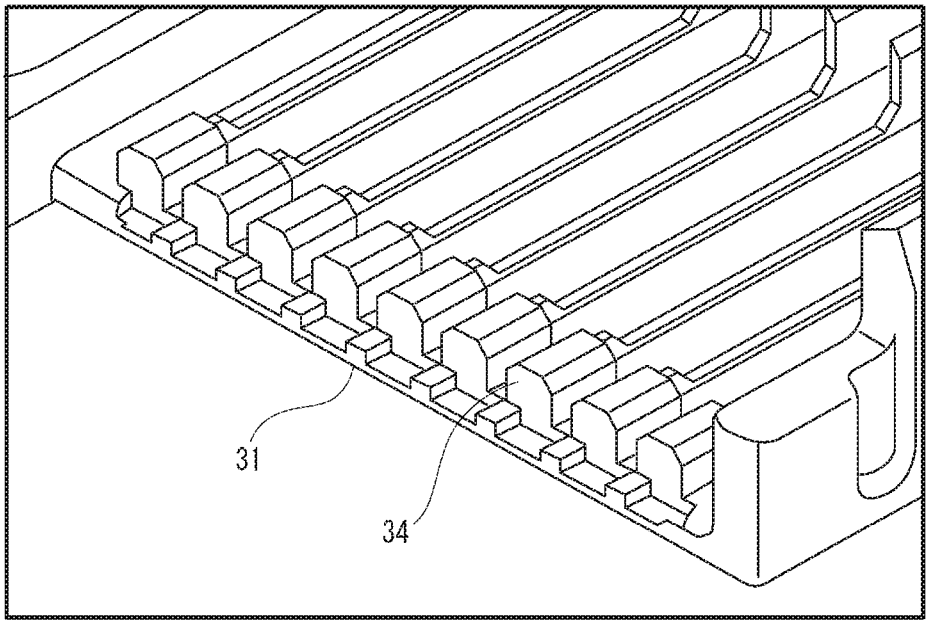
FIG. 15 is an enlarged view of the upper cover inside a frame of FIG. 14.

As shown in FIG. 15, a plurality of protruding portions 34 protruding downward are integrally formed at positions of the plurality of terminal accommodating portions (positions between adjacent standing walls 32) in the width direction on the lower surface of the front end portion of the cover body 31 of the upper cover 30A. As will be described later, when the upper cover 30A is assembled to the housing 20, the protruding portion 34 has a function of pressing the terminal 10 at the primary locking position forward to move the terminal 10 to the regular insertion position.

In the assembled state of the upper cover 30A to the housing 20, the rear portion of the cover body 31 of the upper cover 30A protrudes from the rear end surface of the housing 20 to the rear side. The rear portion 37 of the cover body 31 functions as a so-called connector cover that accommodates and protects the plurality of electric wires W extending from the plurality of terminals 10 accommodated in the plurality of terminal accommodating portions to the rear side by cooperation with the rear portion 37 of the cover body 31 of the lower cover 30B (see FIG. 16 and FIG. 17).

Figure 20:
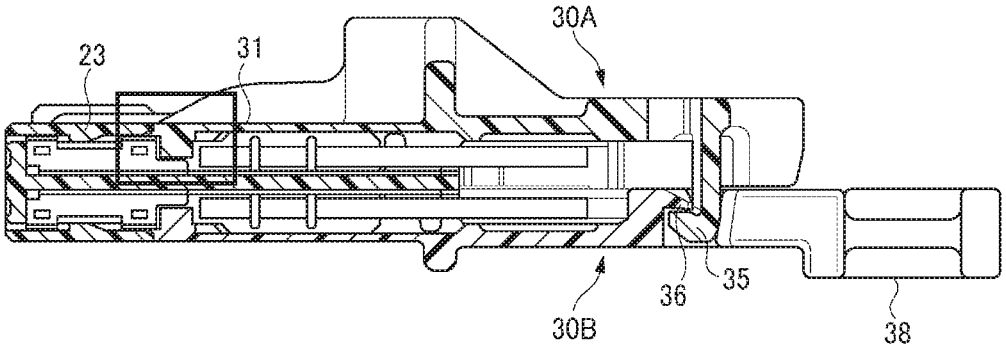
FIG. 20 is a sectional view taken along a line B-B of FIG. 19.

Engaging portions 35 which engage with engaging portions 36 of the lower cover 30B when assembled to the housing 20 (see FIG. 16 and FIG. 17) respectively are integrally formed at a plurality of positions (four positions in this example) of both end portions in the width direction of the cover body 31 of the upper cover 30A (see FIG. 20).

Figure 16:
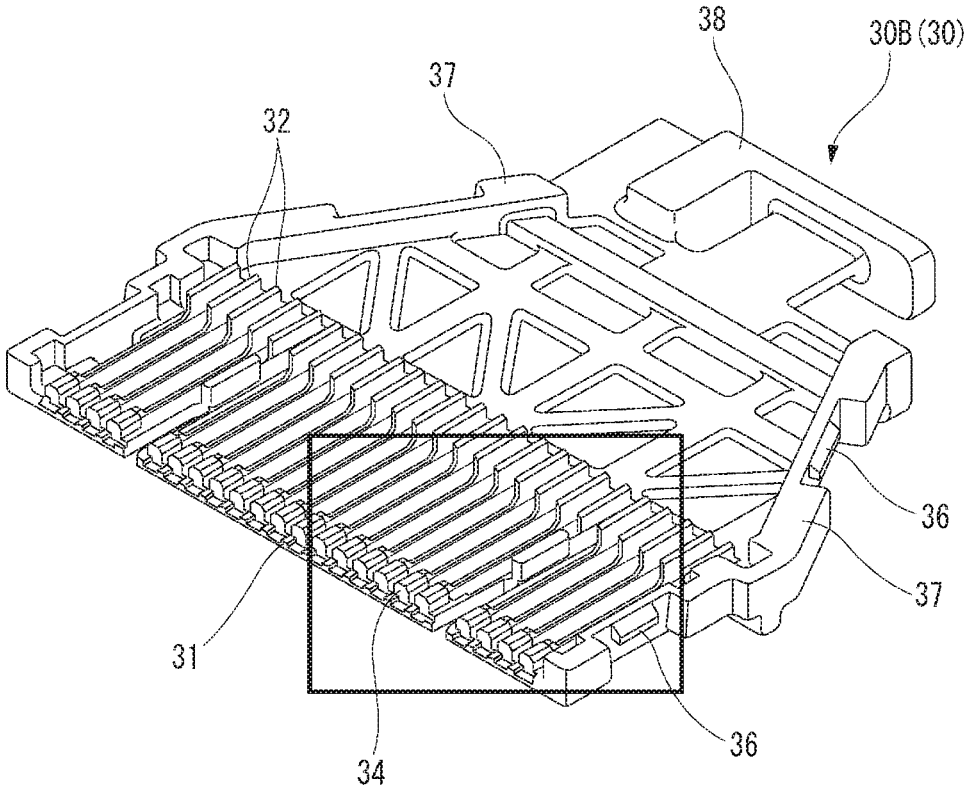
FIG. 16 is a perspective view of a lower cover shown in FIG. 2.
Figure 17:
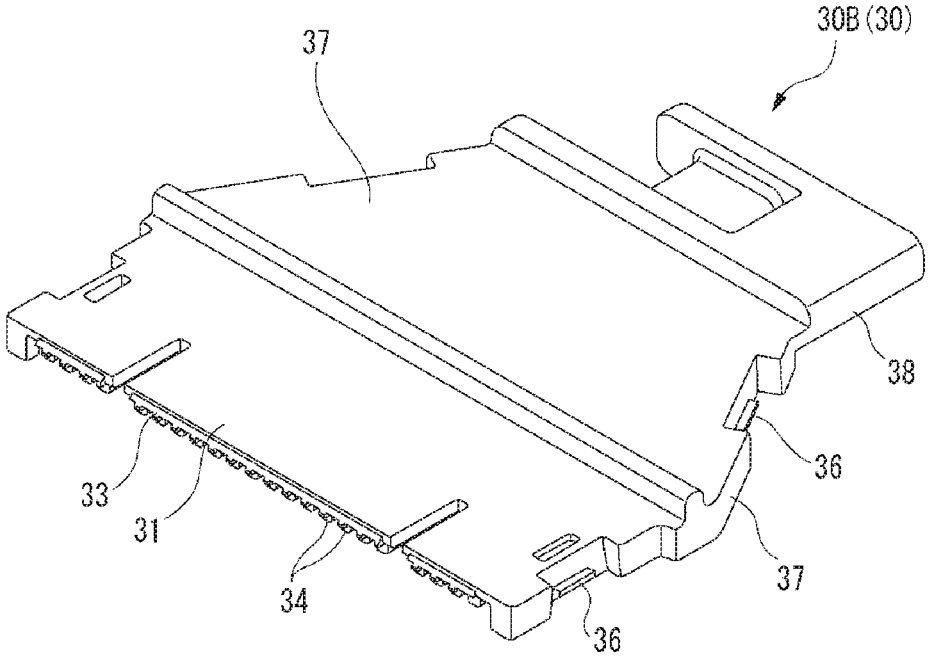
FIG. 17 is a perspective view of the inverted lower cover.
Figure 18:
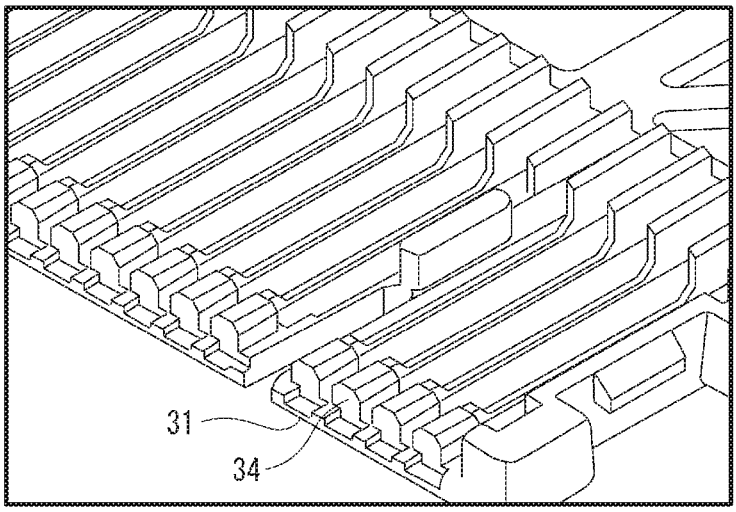
FIG. 18 is an enlarged view of the lower cover inside a frame of FIG. 16.
Figure 19:
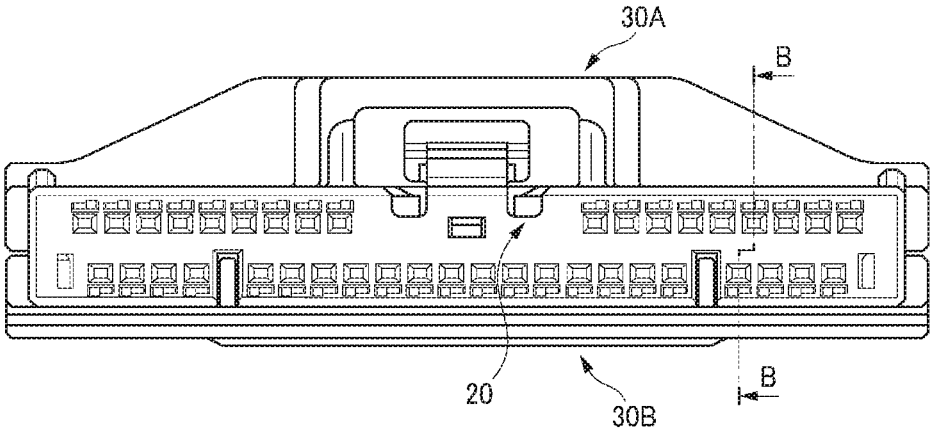
FIG. 19 is a front view of the connector shown in FIG. 1.

Next, the lower cover 30B will be described with reference to FIG. 16 to FIG. 18. FIG. 16 shows the lower cover 30B when assembled to the housing body 21, and FIG. 17 shows the inverted lower cover 30B. Configurations of the upper cover 30A and the lower cover 30B are somewhat different but substantially the same except that the upper cover 30A and the lower cover 30B are symmetrical in a vertical direction. Therefore, the lower cover 30B is given the same reference numeral as the upper cover 30A with respect to the configuration corresponding to each configuration of the upper cover 30A to replace description thereof.

In the lower cover 30B, as shown in FIG. 16 and FIG. 17, a wire holding portion 38 is integrally formed on a further rear side (rear side end portion) of the rear portion 37 functioning as the connector cover. The wire holding portion 38 is a portion used to bundle and hold a plurality of electric wires W extending from the housing 20 to the rear side. The plurality of electric wires W extending from the housing 20 to the rear side are held by the wire holding portion 38 in the bundled state using a tie band or the like.

Figure 21:
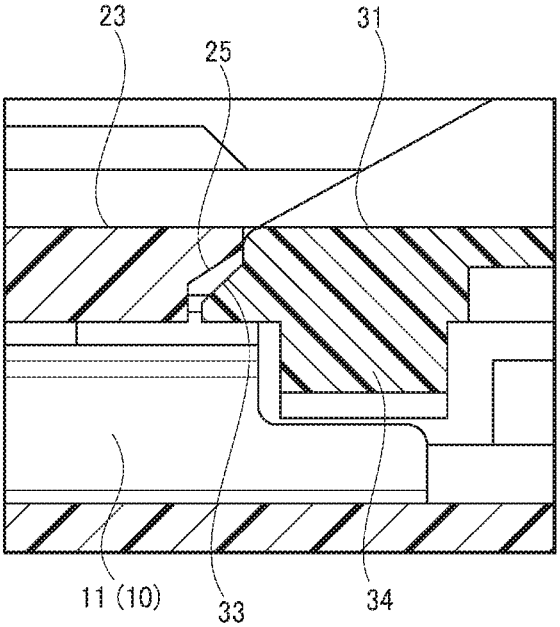
FIG. 21 is an enlarged view of the connector inside a frame of FIG. 20.
Figure 22:
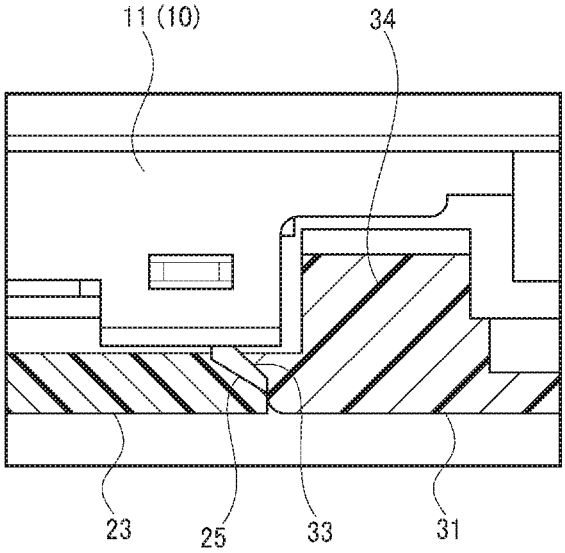
FIG. 22 is a view corresponding to FIG. 21 on a lower cover side.

As shown in FIG. 19 to FIG. 22, in a state where the upper cover 30A and the lower cover 30B are assembled to the housing 20, and in a state where the tapered surface 33 at the front end edge of the upper cover 30A enters a lower side of the tapered surface 25 at the rear end edge of the ceiling wall portion 23 on the upper surface side of the housing 20, the front end edge of the upper cover 30A and the rear end edge of the ceiling wall portion 23 on the upper surface side of the housing 20 are locked (see FIG. 21). In a state where the tapered surface 33 at the front end edge of the upper cover 30B enters an upper part of the tapered surface 25 at the rear end edge of the ceiling wall portion 23 on the lower surface side of the housing 20, the front end edge of the lower cover 30B and the rear end edge of the ceiling wall portion 23 on the lower surface side of the housing 20 are locked (see FIG. 22). Further, the plurality of engaging portions 35 of the upper cover 30A and the plurality of engaging portions 36 of the lower cover 30B are locked to each other (see FIG. 20). By these cooperation, each of the upper cover 30A and the lower cover 30B is assembled to be unmovable relatively to the housing 20, and the upper cover 30A and the lower cover 30B are assembled to be unmovable relatively to each other.

Figure 23:
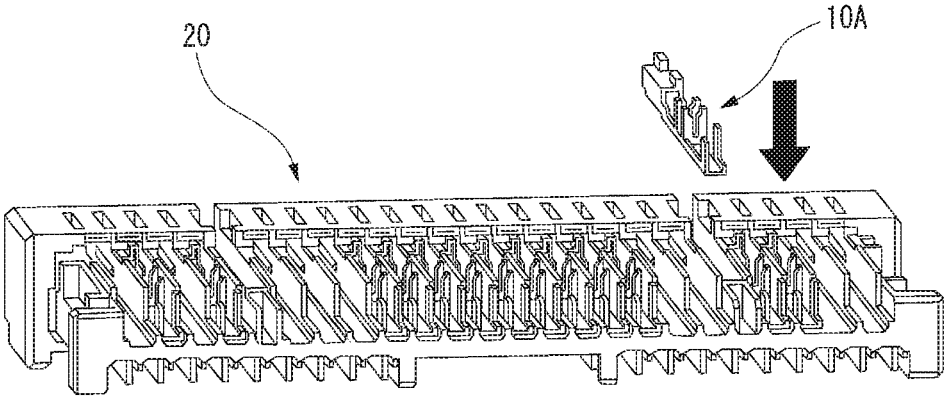
FIG. 23 is a first diagram for illustrating a procedure of assembling the connector.

Next, an assembly procedure of the connector 1 is described with reference to FIG. 23 to FIG. 35. First, as shown in FIG. 23, each of the terminals 10A is arranged in a rear portion where an upper part is opened in a predetermined terminal accommodating portion on the upper surface side (lower surface side in a regular direction) of the housing 20 in an inverted state by using a predetermined device, and a predetermined position of the terminal 10A (typically, a rear end surface of the square tubular connecting portion 11) is pushed forward to the primary locking position shown in FIG. 11 and FIG. 12. Accordingly, the protruding portion 14 of the terminal 10A is engaged with the lance 26 of the housing 20, so that the terminal 10A inserted into the terminal accommodating portion can be prevented from extracting from the housing 20.

Figure 24:
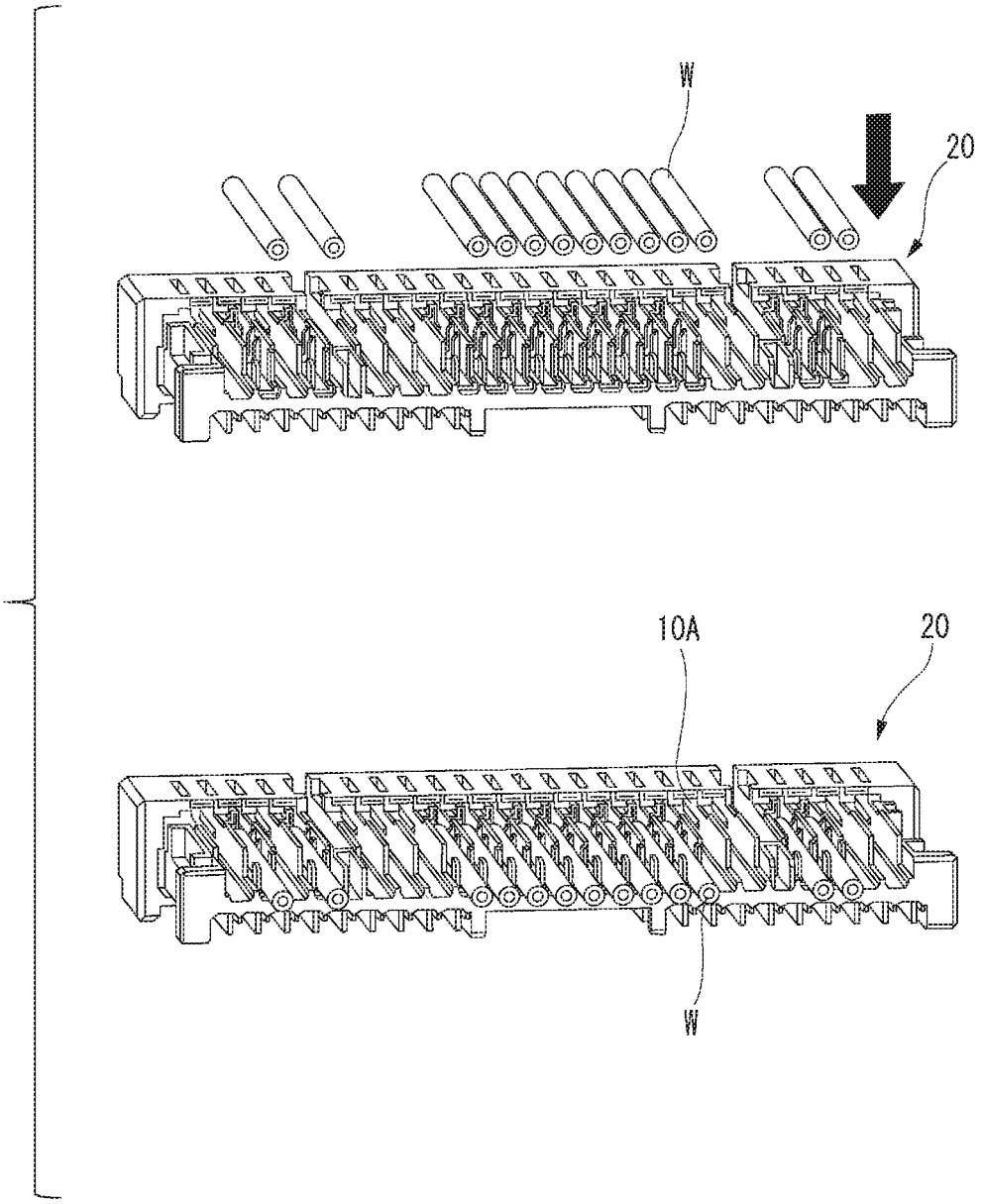
FIG. 24 is a second diagram for illustrating the procedure of assembling the connector.

Next, as shown in FIG. 24, the electric wires W are connected to the terminals 10A inserted into the terminal accommodating portions respectively by using the predetermined device. Specifically, the conductor core wire of the electric wire W is crimped to the pair of crimping blades 15 of the terminal 10A, and coating of the electric wire W is crimped by the pair of caulking pieces 16 of the terminal 10A.

Figure 25:
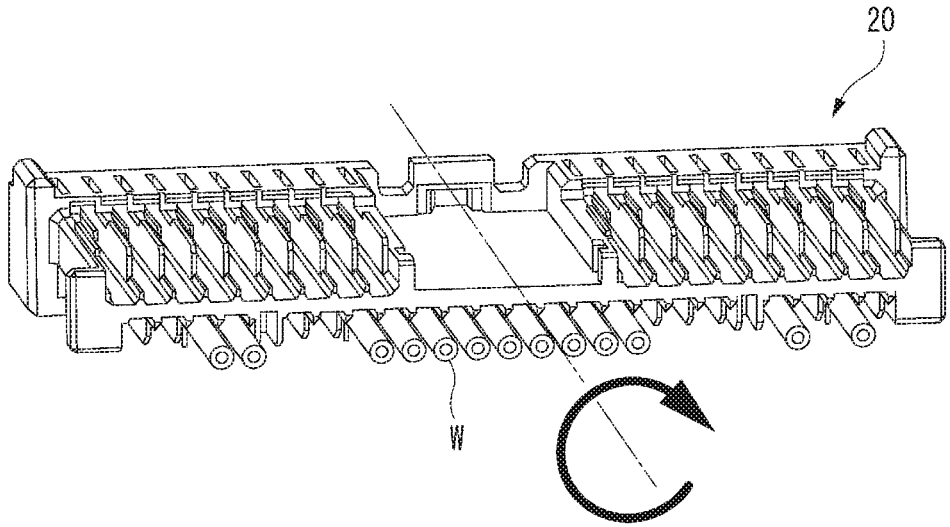
FIG. 25 is a third diagram for illustrating the procedure of assembling the connector.
Figure 26:
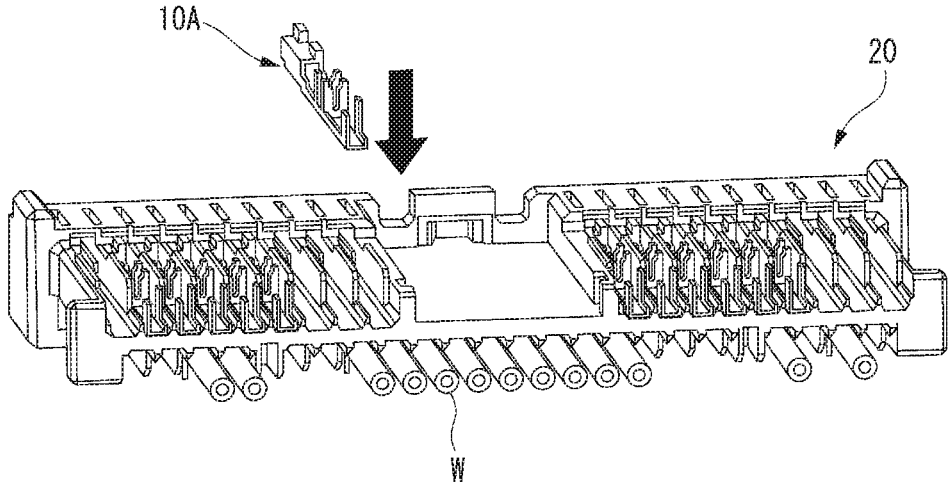
FIG. 26 is a fourth diagram for illustrating the procedure of assembling the connector.
Figure 27:
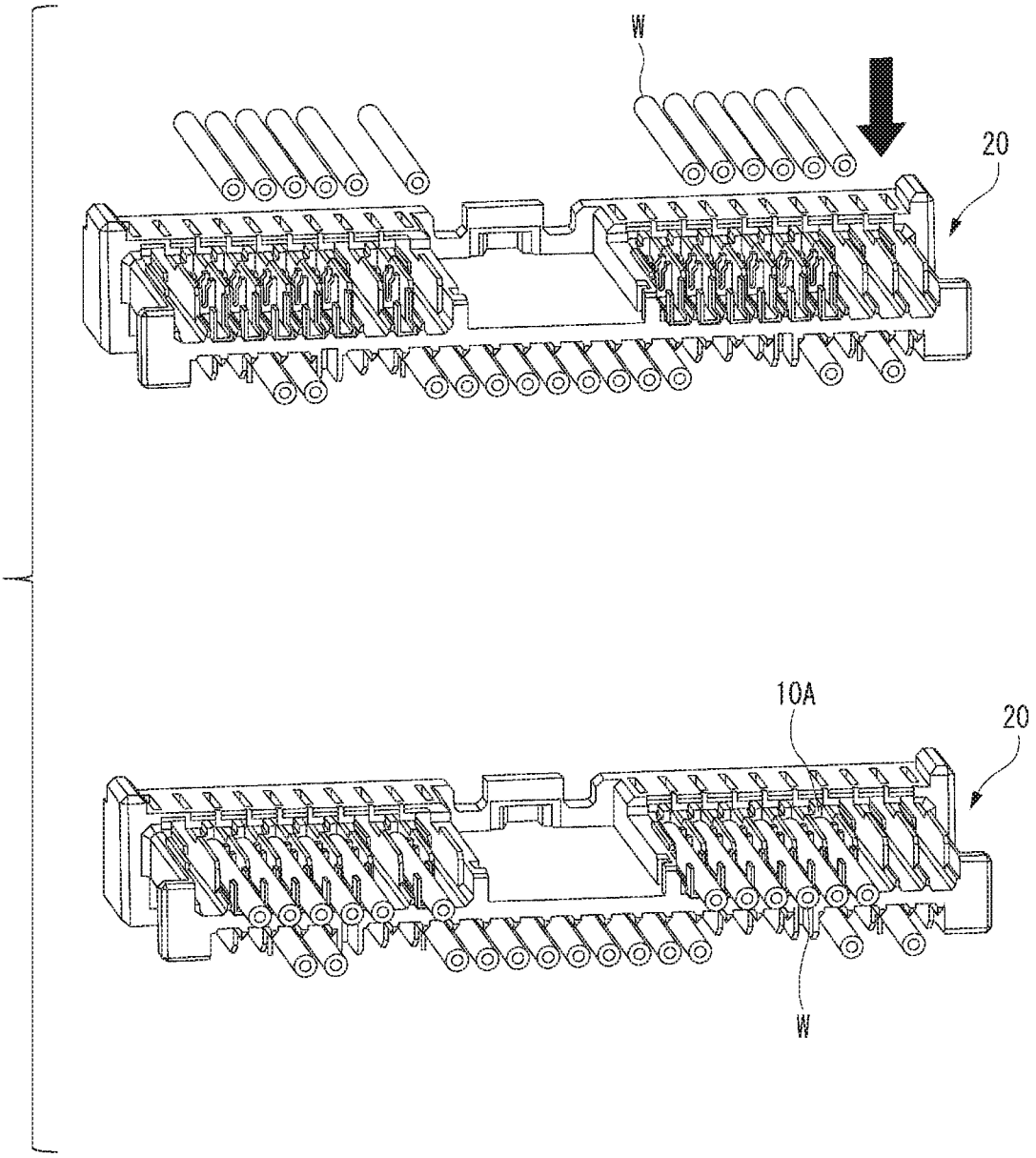
FIG. 27 is a fifth diagram for illustrating the procedure of assembling the connector.

Next, the housing 20 is inverted as shown in FIG. 25. Accordingly, a direction of the housing 20 is a regular direction. In this state, like the procedures shown in FIG. 23 and FIG. 24, the terminals 10A are respectively inserted into the predetermined terminal accommodating portions on the upper surface side of the housing 20 to the primary locking position, and the electric wires W are respectively connected to the inserted terminals 10A as shown in FIG. 26 and FIG. 27.

Figure 28:
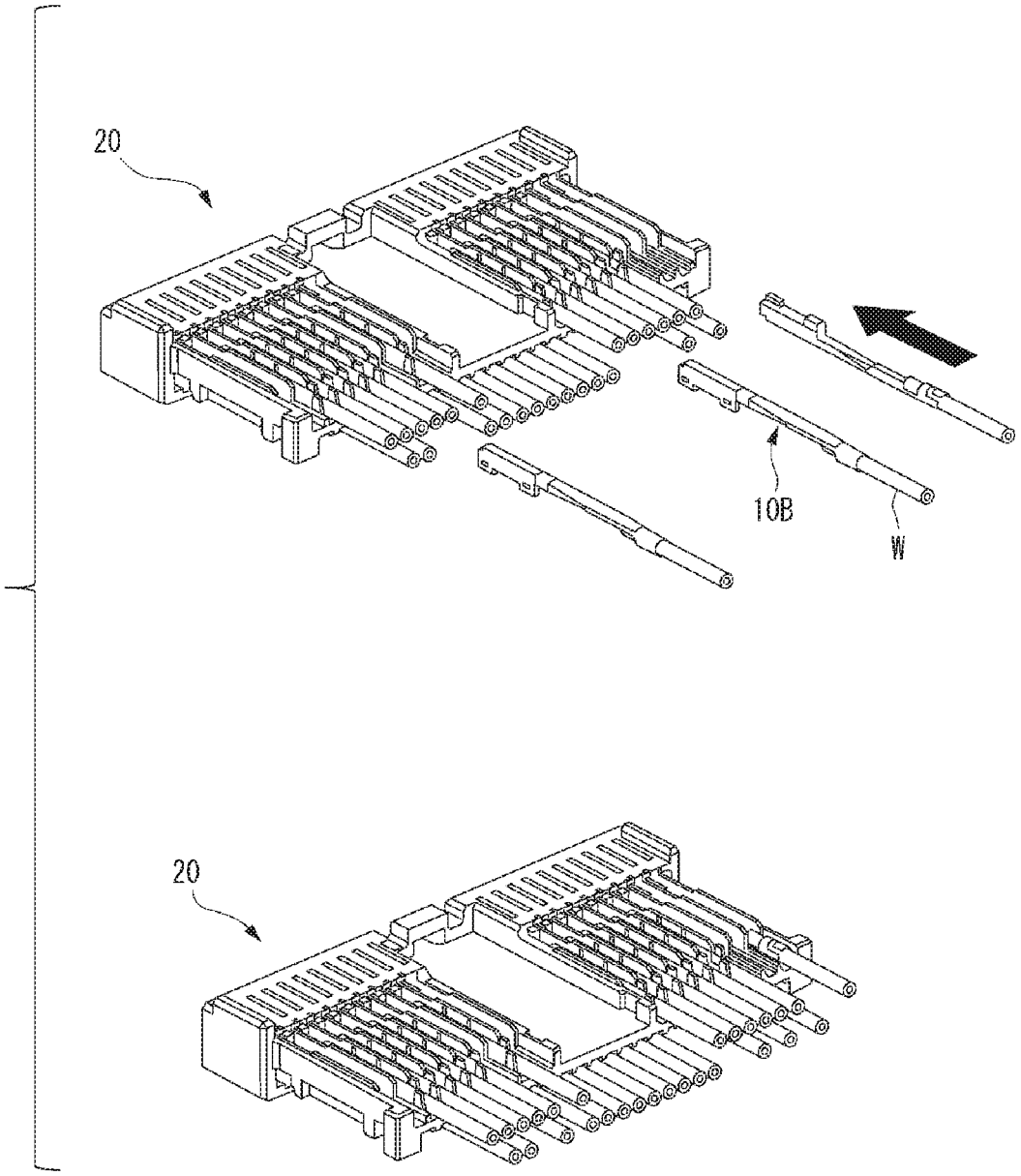
FIG. 28 is a sixth diagram for illustrating the procedure of assembling the connector.

Next, as shown in FIG. 28, the terminals 10B in a state in which the electric wires W are connected in advance are respectively inserted into the predetermined terminal accommodating portions on the upper surface side or the lower surface side of the housing 20 in which the terminals 10A are not inserted yet to the primary locking position by using the predetermined device. This operation may be performed manually by an operator.

Figure 29:
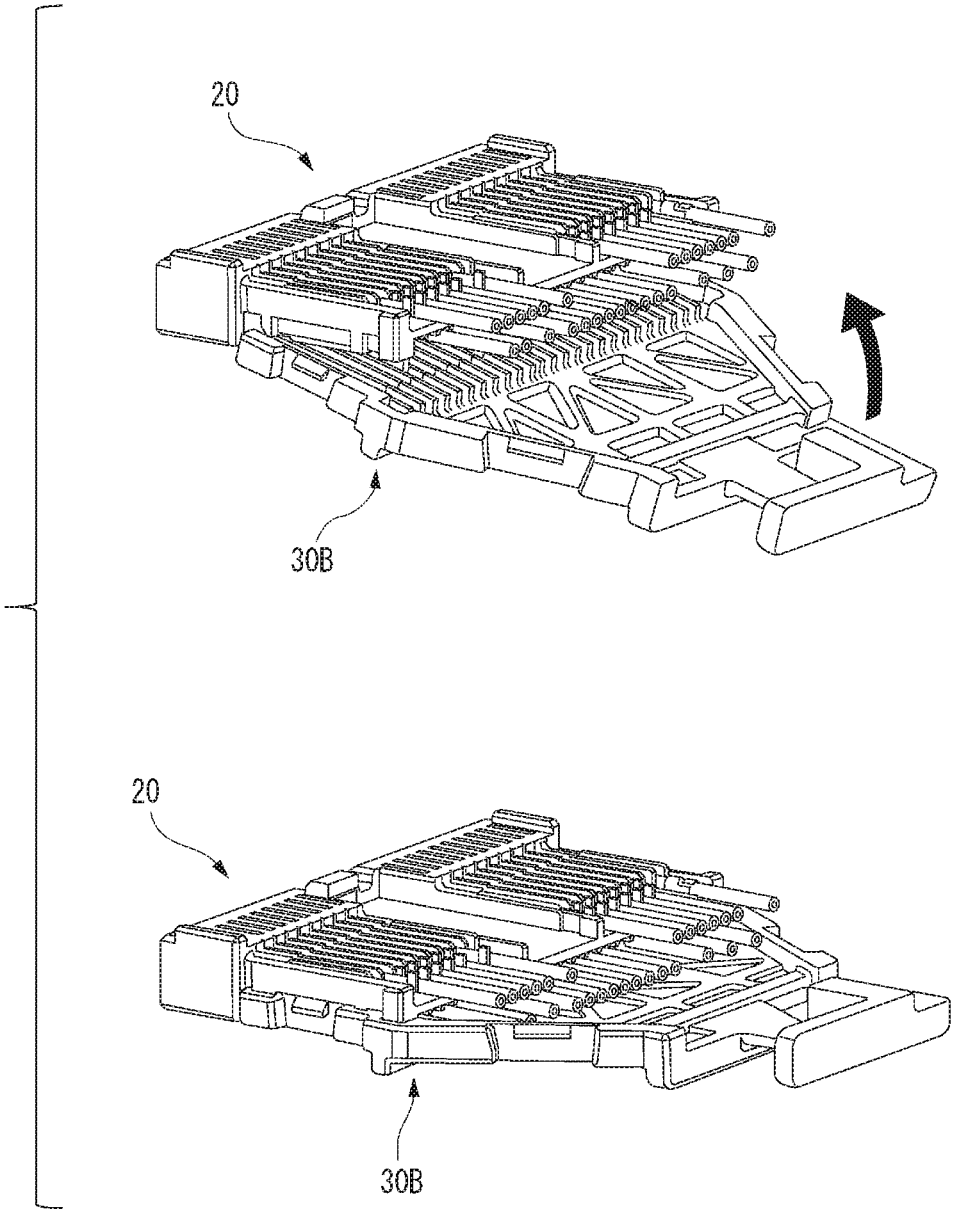
FIG. 29 is a seventh diagram for illustrating the procedure of assembling the connector.
Figure 30:
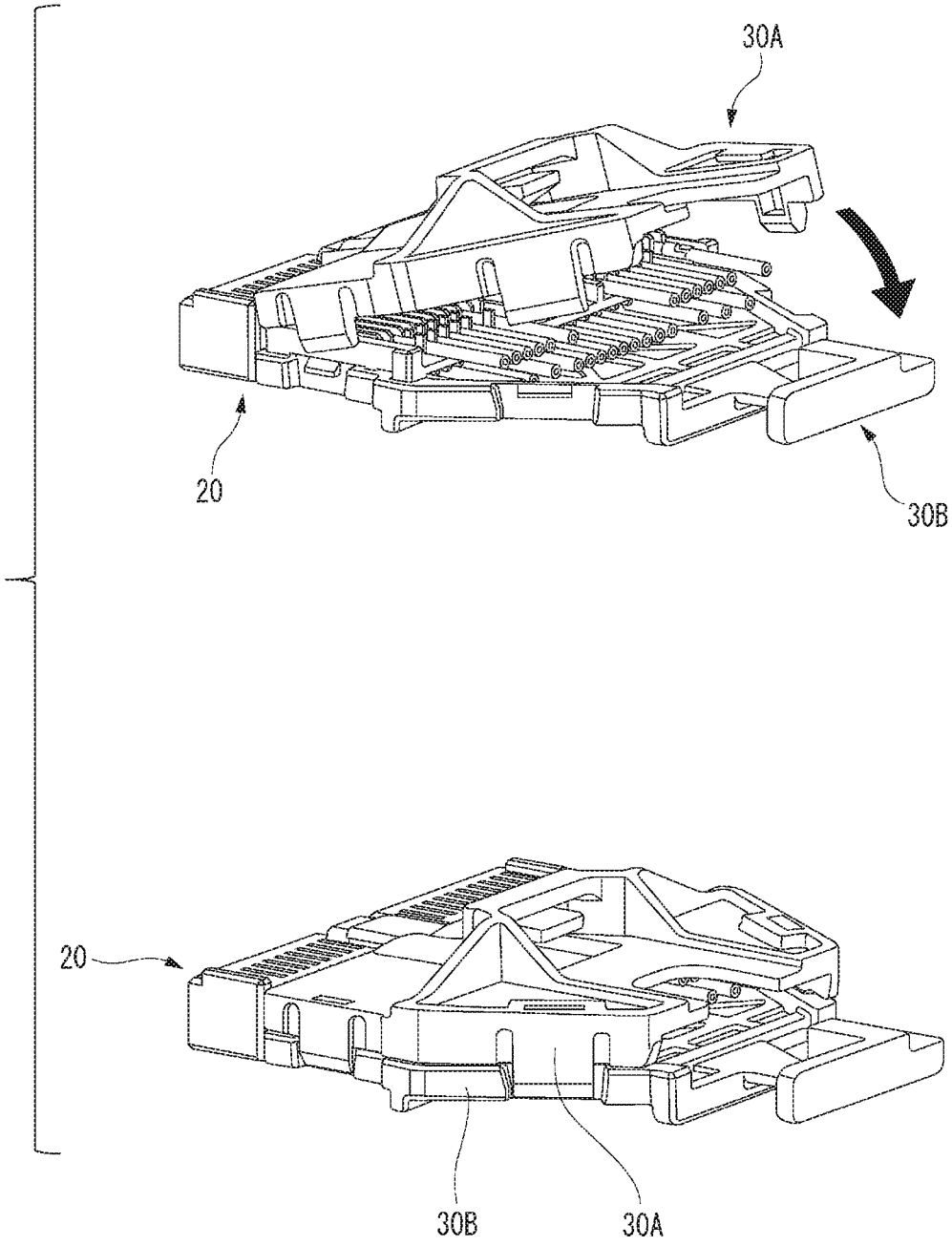
FIG. 30 is an eighth diagram for illustrating the procedure of assembling the connector.

Next, the lower cover 30B is assembled to the housing 20 as shown in FIG. 29, and then the upper cover 30A is assembled to the housing 20 as shown in FIG. 30. Procedures of assembling the upper cover 30A and the lower cover 30B to the housing 20 are substantially the same except that the upper cover 30A and the lower cover 30B are symmetrical in a vertical direction. Therefore, only the procedure of assembling the upper cover 30A to the housing 20 is described below with reference to FIG. 31 to FIG. 35.

Figure 31:
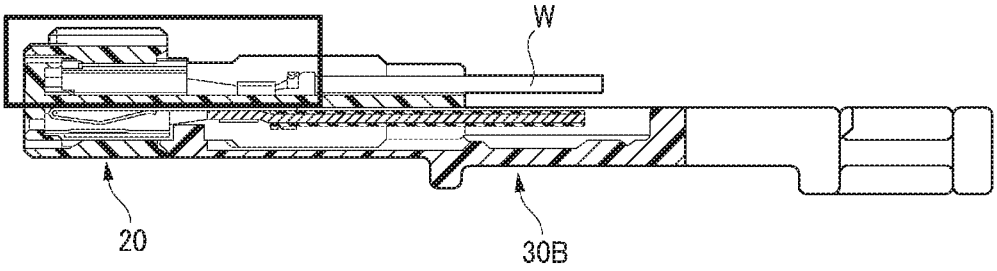
FIG. 31 is a sectional view corresponding to FIG. 8 in the housing in which the terminal is in the primary locking position.
Figure 32:
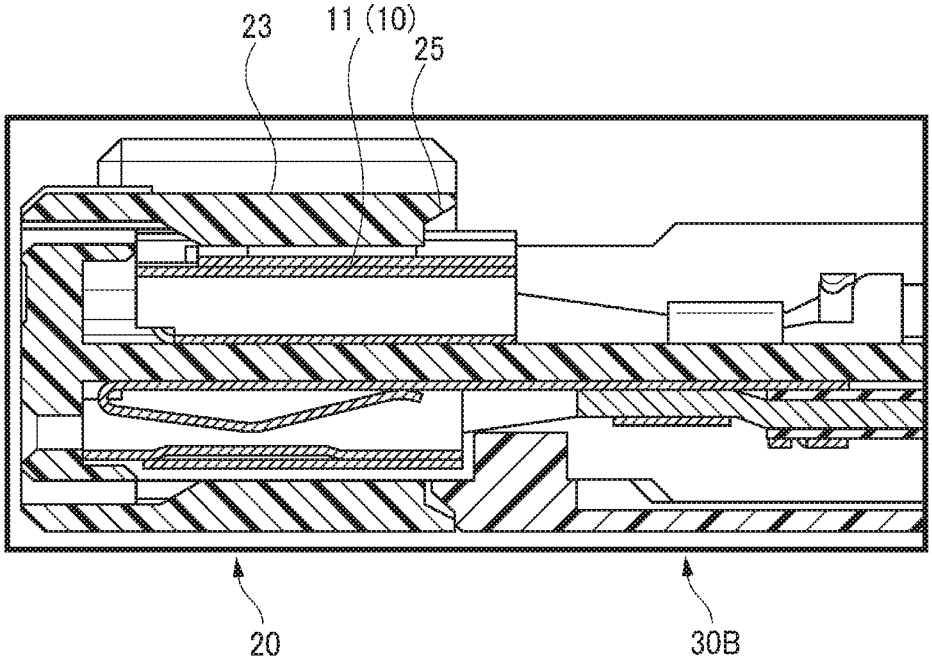
FIG. 32 is an enlarged view of the housing inside a frame of FIG. 31.
Figure 33:
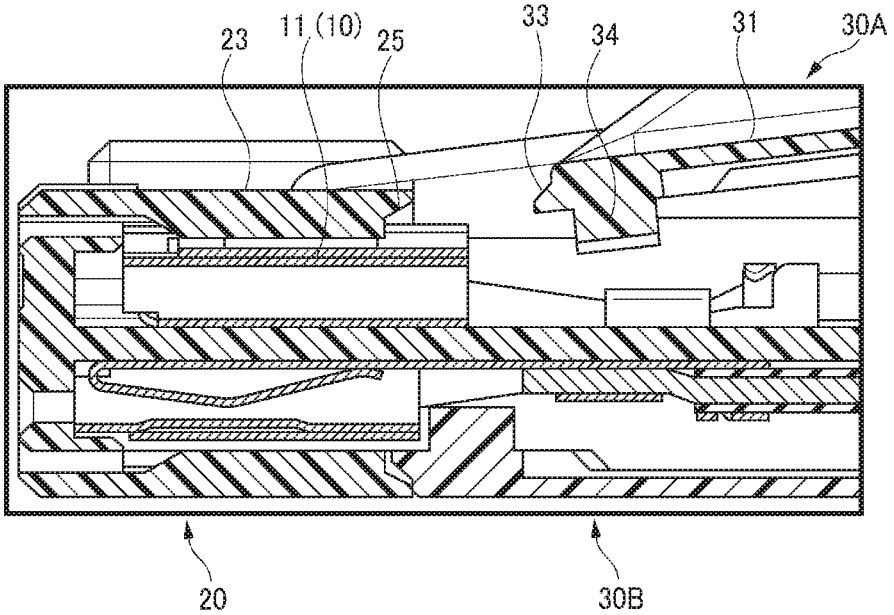
FIG. 33 is a first diagram for illustrating an assembly step shown in FIG. 30 in detail.
Figure 34:
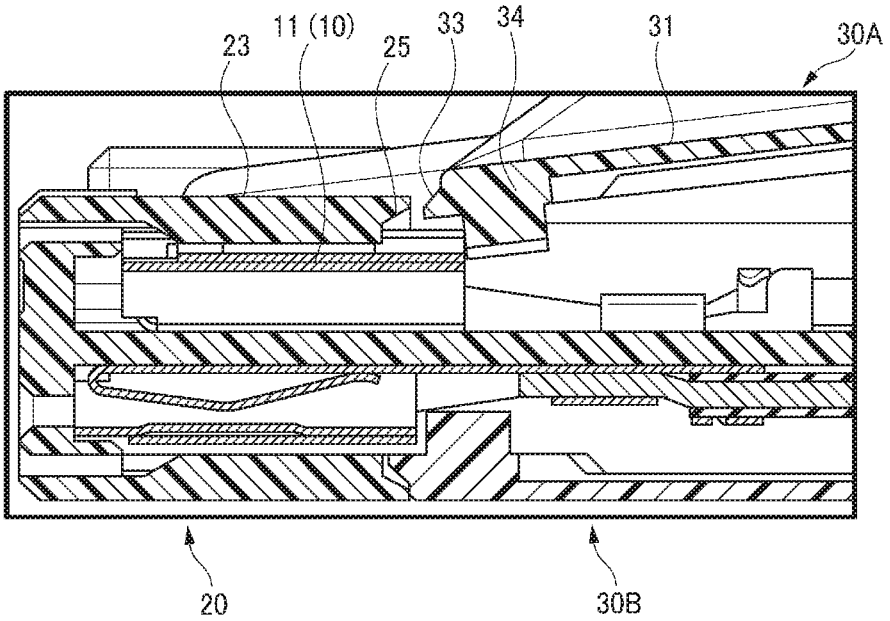
FIG. 34 is a second diagram for illustrating the assembly step shown in FIG. 30 in detail.

As shown in FIG. 31 and FIG. 32, in a state in which the terminal 10 inserted into the terminal accommodating portion is at the primary locking position, first, as shown in FIG. 33, the front end edge of the upper cover 30A (cover body 31) approaches toward the rear end edge of the ceiling wall portion 23 of the housing 20 while maintaining a state in which the rear side of the upper cover 30A is inclined upward compared with the front side, and as shown in FIG. 34, the protruding portion 34 of the upper cover 30A is abutted against the rear end of the connecting portion 11 of the terminal 10.

Next, the upper cover 30A is moved forward in parallel to the housing 20 until the tapered surface 33 at the front end edge of the upper cover 30A enters the lower side of the tapered surface 25 at the rear end edge of the ceiling wall portion 23 (until the front end edge of the upper cover 30A is engaged with the rear end edge of the ceiling wall portion 23) while maintaining the state (that is, a state in which the upper cover 30A is inclined, and a state in which the protruding portion 34 abuts on the connecting portion 11 of the terminal 10). At this time, due to the pressing of the protruding portion 34, the terminal 10 moves from the primary locking position to the regular insertion position along with the forward movement of the upper cover 30A.

Figure 35:
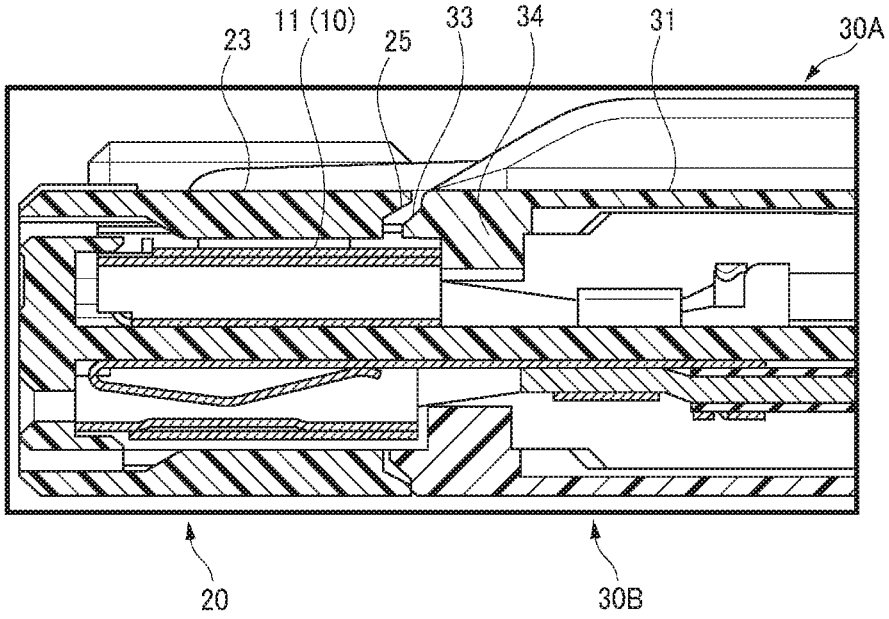
FIG. 35 is a third diagram for illustrating the assembly step shown in FIG. 30 in detail.

Next, while maintaining a state in which the front end edge of the upper cover 30A is engaged with the rear end edge of the ceiling wall portion 23, the upper cover 30A in the inclined state is rotated in a direction in which the rear side of the upper cover 30A approaches the housing 20 using a tip end side of the upper cover 30A as a fulcrum, as shown in FIG. 35. Accordingly, the plurality of engagement portions 35 of the upper cover 30A and the plurality of engagement portions 36 of the lower cover 30B are engaged with each other to obtain a state in which the upper cover 30A and the lower cover 30B are assembled to the housing 20, as shown in FIG. 20 described above. Finally, the plurality of electric wires W extending rearward from the housing 20 are held in the wire holding portion 38 in a bundled state using a tie band or the like. Thus, assembly of the connector 1 is completed.

As shown in FIG. 35, in a state where the upper cover 30A is assembled to the housing 20, the protruding portion 34 of the upper cover 30A is in face-to-face contact with or adjoins the rear end face of the connecting portion 11 of the terminal 10. Therefore, the function of retaining the terminal 10 from the housing 20 is exhibited. That is, in addition to the engagement of the protruding portion 14 of the terminal 10 with the lance 26, a so-called double locking state is obtained by the engagement of the connection portion 11 of the terminal 10 with the protruding portion 34.

As described above, the upper cover 30A is designed to be assembled to the housing 20 in a regular state only by rotating the upper cover 30A in the inclined state using the tip end side of the upper cover 30A as a fulcrum. Even if the upper cover 30A is parallelly moved from the upper side to the lower side to be assembled to the housing 20 in a state where the upper cover 30A is maintained in parallel to the housing 20, the upper cover 30A cannot be assembled since the front end edge of the upper cover 30A interferes with the rear end edge of the top ceiling wall portion 23 Interference with the edge prevents assembly.

As described above, according to the connector 1 according to the embodiment of the present invention, since the upper part of the rear portion of the terminal accommodating portion of the housing 20 is opened, the terminal 10 can be easily inserted to the primary locking position in the vicinity of the regular insertion position in the terminal accommodating portion while holding the terminal 10. In this state, the cover 30 is assembled to the housing 20. In the assembly process, when the cover 30 is moved to the front side with respect to the housing 20, the terminal 10 in the primary locking position is pressed forward by the protruding portion 34 provided on the cover 30, so that the terminal 10 can be moved to the regular insertion position.

As described above, even when the electric wire W connected to the terminal 10 is thin, the terminal 10 can be certainty inserted to the regular insertion position. Further, even when the cover 30 is assembled to the housing 20 in a state where the terminal 10 is in the primary locking position, the cover 30 is detached from the housing 20, the cover 30 is assembled to the housing 20 again while pressing the terminal 10 forward by the protruding portion 34 of the cover 30, so that it is possible to certainly insert the terminal 10 in the primary locking position to the regular insertion position.

Further, a shape of each component is designed such that the terminal 10 reaches the (approximately) regular insertion position in a stage where the front end edge of the cover 30 moving forward with respect to the housing 20 enters the lower side of the rear end edge of the ceiling wall portion 23 of the housing 20. Accordingly, after the terminal 10 is inserted to the (approximately) regular insertion position by the protruding portion 34 of the cover 30 in the inclined state, the cover 30 can be assembled to the housing 20 by rotating the cover 30 using the tip end side of the cover 30 as a fulcrum. In addition, the terminal can reach the regular insertion position. The terminal 10 can reach the regular insertion position.

<Other Modes>

The present invention is not limited to the above embodiment, and various modifications can be adopted within the scope of the present invention. For example, the present invention is not limited to the above-described embodiment, and can be appropriately modified, improved or the like. In addition, the material, shape, size, number, arrangement position, and the like of each component in the above-described embodiment are arbitrary and are not limited as long as the present invention can be achieved.

Figure 36:
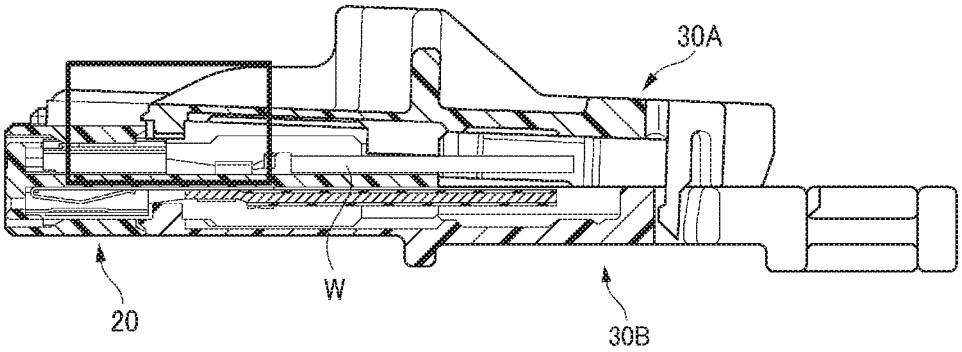
FIG. 36 is a view corresponding to FIG. 31 in a state in which the upper cover is assembled to the housing in which the terminal is in the primary locking position.
Figure 37:
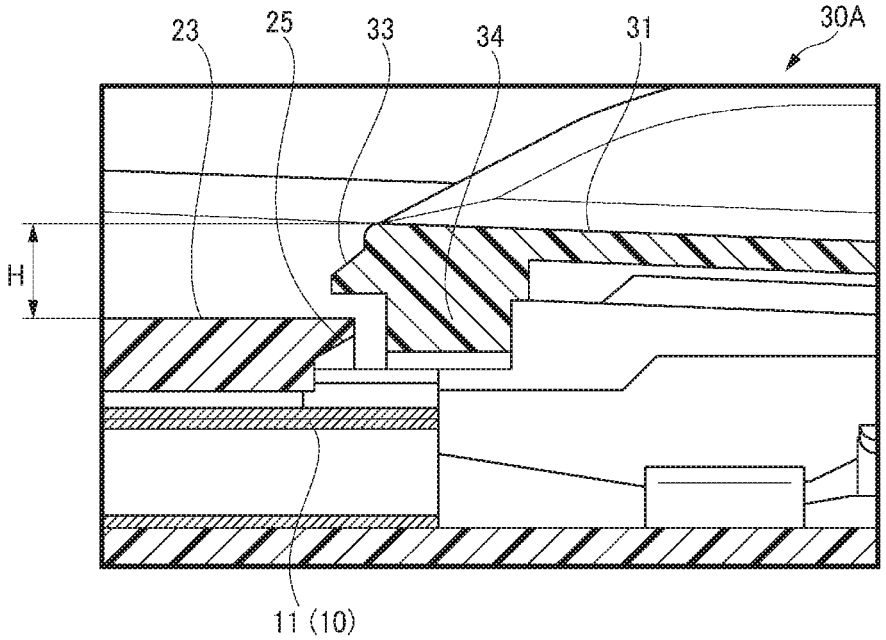
FIG. 37 is an enlarged view of the housing and the upper cover inside a frame of FIG. 36.

In the embodiment described above, as shown in FIG. 36 and FIG. 37, the protruding portion 34 of the cover 30 interferes with the terminal 10 (more specifically, the connecting portion 11) in a state in which the terminal 10 is in the primary locking position, so that a case where the cover 30 is assembled (may be assembled) to the housing 20 is assumed in a state in which the front side of the cover 30 is inclined from the rear side in a direction away from the housing 20 (specifically, the front end edge of the upper cover 30A is not engaged with the rear end edge of the ceiling wall portion 23, and the plurality of engagement portions 35 of the upper cover 30A and the plurality of engagement portions 36 of the lower cover 30B are locked to each other).

According to this, in the state where the terminal 10 is in the primary locking position, a floating amount H (floating height in the vertical direction, see FIG. 37) from the housing on the front side of the cover 30 can be increased as compared with an aspect in which the cover 30 can be assembled in parallel to the housing 20 (not inclined). Therefore, when it is detected that the cover 30 is not assembled properly or the terminal 10 is inserted halfway, the detection accuracy can be improved by measuring the floating amount H using a checker fixture or the like. Furthermore, even though the terminal 10 and the housing 20 are miniaturized with a demand for miniaturization of the connector 1, it becomes possible to certainly detect the halfway insertion of the terminal 10.

Figure 38:
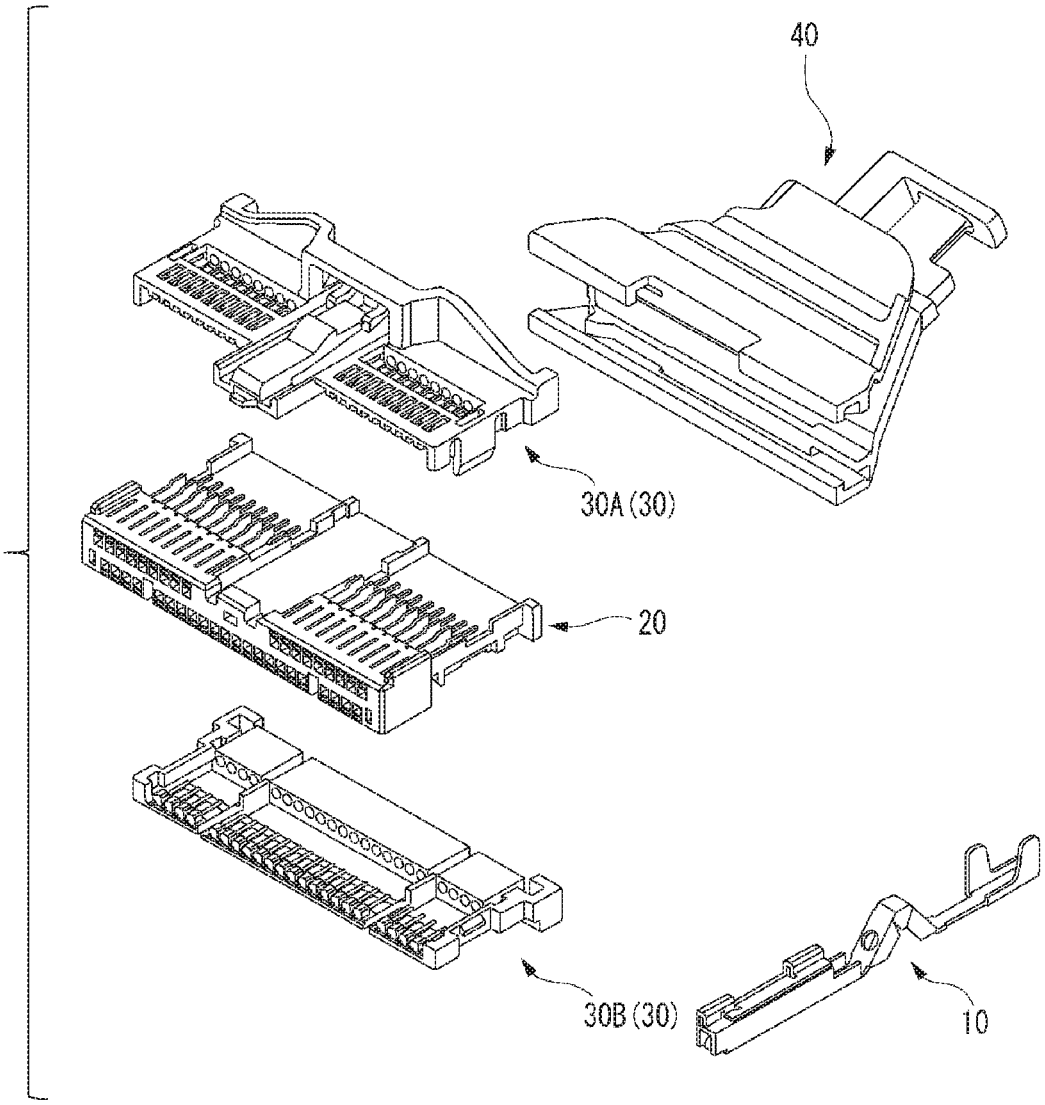
FIG. 38 is an exploded perspective view of a connector according to a modification of the present embodiment.

Further, in the above embodiment, the rear portion 37 functioning as the connector cover and the wire holding portion 38 are integrally provided on a rear portion of the cover 30 assembled to the housing 20. In contrast, as shown in FIG. 38, separately from the cover 30, a connector cover 40 in which portions corresponding to the rear portion 37 and the wire holding portion 38 in the above embodiment are configured integrally may be provided.

Here, characteristics of the embodiment of the connector 1 according to the present invention described above is briefly summarized and listed in the following [1] to [3].

[1] A connector (1) including:

a terminal (10) configured to be connected to a wire (W) and extends in a front-rear direction;

a housing (20) has a plate-like shape and has a terminal accommodating portion configured to accommodate the terminal (10), the housing having a ceiling wall portion (23) that blocks an upper of a front portion of the terminal accommodating portion and an opening portion which is opened at an upper of a rear portion of the terminal accommodating portion; and a flat plate-like cover (30) configured to cover the opening portion of the rear portion of the terminal accommodating portion when the cover (30) is assembled to the housing (20), wherein a protruding portion (34) is provided on a lower surface of a front end portion of the cover (30) and the protruding portion (34) protrudes downward; and wherein the protruding portion (34) presses a part of the terminal (10) located in a primary locking position forward in the front-rear direction to move the terminal (10) from the primary locking position to a regular insertion position when the cover (30) is assembled to the housing (20).

[2] The connector [1] according to the above [1], in which the cover (30) is configured to be assembled to the housing (20) by moving the cover (30) forward with respect to the housing (20) while the terminal (10) is moved forward by pressing the protruding portion (34) until a front end edge of the cover (30) enters under a rear end edge of the ceiling wall portion (23) while maintaining a state in which a rear part of the cover (30) is inclined upward from a front part in a direction away from the housing (20), and then bringing the rear part of the cover (30) near to the housing (20).

[3] The connector [1] according to the above [1] or the above [2], in which the cover (30) is configured to assembled to the housing (20) in a state where the front part of the cover (30) is inclined upward from the rear side in a direction away from the housing (20) while the protruding portion (34) interferes with the terminal (10) when the terminal (10) is located in the primary locking position.

What is claimed is:

1. A connector comprising:

a terminal configured to be connected to a wire and extend in a front-rear direction;

a housing which has a plate-like shape and has a terminal accommodating portion configured to accommodate the terminal, wherein the housing has a ceiling wall portion that blocks an upper of a front portion of the terminal accommodating portion and an opening portion which is opened at an upper of a rear portion of the terminal accommodating portion; and a flat plate-like upper cover configured to cover the opening portion of the rear portion of the terminal accommodating portion when the upper cover is assembled to the housing;

a flat plate-like lower cover configured to cover the opening portion of the rear portion of the terminal accommodating portion when the lower cover is assembled to the housing, wherein a protruding portion is provided on a lower surface of a front end portion of the upper cover and the protruding portion protrudes downward;

wherein the protruding portion presses a part of the terminal located in a primary locking position forward in the front-rear direction to move the terminal from the primary locking position to a regular insertion position when the upper cover is assembled to the housing, wherein the housing has an upper surface side and a lower surface side, in which the lower surface side is spaced away from the upper surface side, and the upper cover is assembled to the upper surface side of the housing and the lower cover is assembled to the lower surface side of the housing, and wherein the upper cover has first engaging portions, and the lower cover has second engaging portions in which the second engaging portions directly lock to the first engaging portions when the upper and lower covers are assembled to the housing.

2. The connector according to claim 1, wherein the upper cover is configured to be assembled to the housing by moving the upper cover forward with respect to the housing while the terminal is moved forward by pressing the protruding portion until a front end edge of the upper cover enters under a rear end edge of the ceiling wall portion while maintaining a state in which a rear part of the upper cover is inclined upward from a front part in a direction away from the housing, and then bringing the rear part of the upper cover near to the housing.

3. The connector according to claim 1, wherein the upper cover and the lower cover are configured to be assembled to the housing in a state where the front part of the upper cover is inclined upward from a rear side in a direction away from the housing and the second engaging portions directly lock to the first engaging portions while the protruding portion interferes with the terminal when the terminal is located in the primary locking position.

4. The connector according to claim 1, wherein the first engaging portions and the second engaging portions are spaced away from the terminal in the front-rear direction.

* * * * *